US009581948B2

(12) United States Patent
Takagi et al.

(10) Patent No.: US 9,581,948 B2
(45) Date of Patent: Feb. 28, 2017

(54) FIXING DEVICE AND IMAGE FORMING APPARATUS

(71) Applicants: Hiromasa Takagi, Tokyo (JP); Kenji Ishii, Kanagawa (JP); Takayuki Seki, Kanagawa (JP); Keitaro Shoji, Kanagawa (JP)

(72) Inventors: Hiromasa Takagi, Tokyo (JP); Kenji Ishii, Kanagawa (JP); Takayuki Seki, Kanagawa (JP); Keitaro Shoji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/504,626

(22) Filed: Oct. 2, 2014

(65) Prior Publication Data

US 2015/0110531 A1 Apr. 23, 2015

(30) Foreign Application Priority Data

Oct. 18, 2013 (JP) ..... 2013-217187
Aug. 8, 2014 (JP) ..... 2014-162178

(51) Int. Cl.
*G03G 15/20* (2006.01)

(52) U.S. Cl.
CPC ..... *G03G 15/206* (2013.01); *G03G 15/2042* (2013.01); *G03G 15/2053* (2013.01)

(58) Field of Classification Search
CPC ..... G03G 15/2053; G03G 15/2064; G03G 15/206; G03G 15/2042
(Continued)

(56) References Cited

U.S. PATENT DOCUMENTS 5,278,618 A * 1/1994 Mitani ..... G03G 15/2064 219/216
2008/0298862 A1 12/2008 Shinshi
(Continued)

FOREIGN PATENT DOCUMENTS

JP 10-301410 11/1998
JP 10-301411 11/1998
(Continued)

OTHER PUBLICATIONS

U.S. Appl. No. 14/207,748, filed Mar. 13, 2014.
U.S. Appl. No. 14/467,135, filed Aug. 25, 2014.
U.S. Appl. No. 14/467,341, filed Aug. 25, 2014.

*Primary Examiner* — Walter L Lindsay, Jr.
*Assistant Examiner* — Philip Marcus T Fadul
(74) *Attorney, Agent, or Firm* — Oblon, McClelland, Maier & Neustadt, L.L.P.

(57) ABSTRACT

A fixing device includes a fixing rotator and a pressure rotator pressed against a nip formation pad via the fixing rotator to form a fixing nip between the fixing rotator and the pressure rotator, through which a recording medium is conveyed. The nip formation pad includes an increased thermal conduction portion having an increased thermal conductivity and a decreased thermal conduction portion having a decreased thermal conductivity and being inboard from the increased thermal conduction portion in the axial direction of the fixing rotator. The increased thermal conduction portion is disposed opposite a non-conveyance span of the fixing rotator where the recording medium is not conveyed and includes an inboard edge inboard from a lateral edge of the recording medium toward a center of the recording medium in the axial direction of the fixing rotator by a predetermined first distance.

28 Claims, 11 Drawing Sheets

(58) Field of Classification Search
USPC ..... 399/329
See application file for complete search history.

(56) References Cited

U.S. PATENT DOCUMENTS

| | | | | |
|---|---|---|---|---|
| 2011/0116848 | A1* | 5/2011 | Yamaguchi | G03G 15/2064 399/329 |
| 2012/0170957 | A1* | 7/2012 | Lim | G03G 15/2064 399/331 |
| 2013/0243465 | A1* | 9/2013 | Honda | G03G 15/2053 399/69 |
| 2014/0341622 | A1* | 11/2014 | Okabayashi | G03G 15/2053 399/329 |

FOREIGN PATENT DOCUMENTS

| | | |
|---|---|---|
| JP | 2004-286922 | 10/2004 |
| JP | 2009-003410 | 1/2009 |
| JP | 2010-032625 | 2/2010 |
| JP | 2010-079309 | 4/2010 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-217187, filed on Oct. 18, 2013, and 2014-162178, filed on Aug. 8, 2014, in the Japanese Patent Office, the entire disclosure of each of which is hereby incorporated by reference herein.

BACKGROUND

Technical Field

Exemplary aspects of the present invention relate to a fixing device and an image forming apparatus, and more particularly, to a fixing device for fixing an image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and at least one heater disposed opposite the fixing rotator to heat the fixing rotator. A nip formation pad is disposed opposite an inner circumferential surface of the fixing rotator. A pressure rotator is pressed against the nip formation pad via the fixing rotator to form a fixing nip between the fixing rotator and the pressure rotator, through which a recording medium is conveyed. The nip formation pad includes an increased thermal conduction portion having an increased thermal conductivity to conduct heat in a thickness direction of the nip formation pad perpendicular to an axial direction of the fixing rotator and a decreased thermal conduction portion having a decreased thermal conductivity to conduct heat in the thickness direction of the nip formation pad and being inboard from the increased thermal conduction portion in the axial direction of the fixing rotator. The increased thermal conduction portion is disposed opposite a non-conveyance span of the fixing rotator where the recording medium is not conveyed and includes an inboard edge inboard from a lateral edge of the recording medium toward a center of the recording medium in the axial direction of the fixing rotator by a predetermined first distance.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator rotatable in a predetermined direction of rotation and at least one heater disposed opposite the fixing rotator to heat the fixing rotator. A nip formation pad is disposed opposite an inner circumferential surface of the fixing rotator. A pressure rotator is pressed against the nip formation pad via the fixing rotator to form a fixing nip between the fixing rotator and the pressure rotator, through which the recording medium is conveyed. The nip formation pad includes an increased thermal conduction portion having an increased thermal conductivity to conduct heat in a thickness direction of the nip formation pad perpendicular to an axial direction of the fixing rotator and a decreased thermal conduction portion having a decreased thermal conductivity to conduct heat in the thickness direction of the nip formation pad and being inboard from the increased thermal conduction portion in the axial direction of the fixing rotator. The increased thermal conduction portion is disposed opposite a non-conveyance span of the fixing rotator where the recording medium is not conveyed and includes an inboard edge inboard from a lateral edge of the recording medium toward a center of the recording medium in the axial direction of the fixing rotator by a predetermined first distance.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
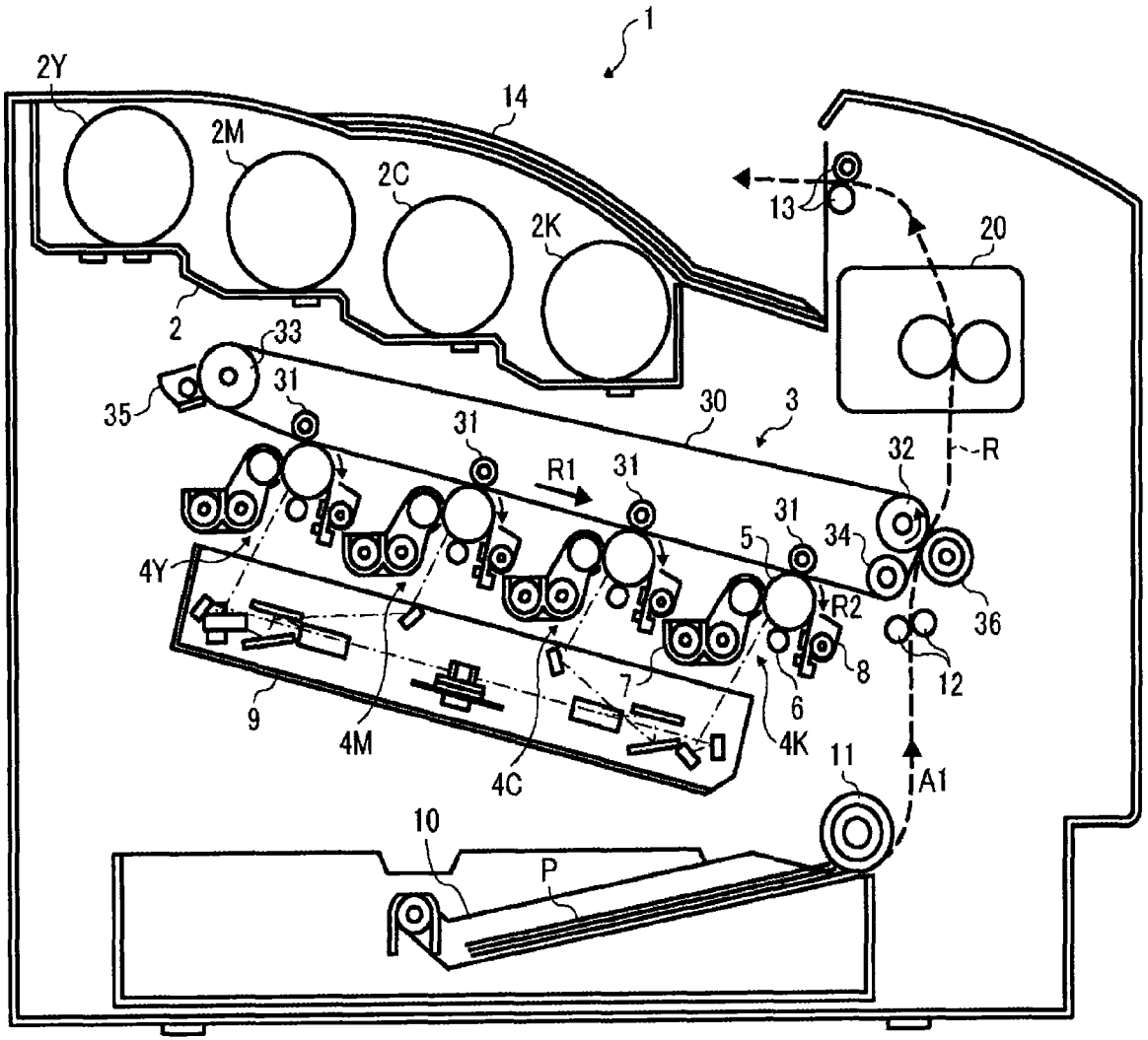
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., yellow, magenta, cyan, and black toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Additionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a conveyance roller pair or a timing roller pair feeds the sheet P conveyed from the feed roller 11 toward the secondary transfer nip at a proper time.

The conveyance path R is further provided with a fixing device 20 located above the secondary transfer nip, that is, downstream from the secondary transfer nip in the sheet conveyance direction A1. The fixing device 20 fixes a toner image transferred from the intermediate transfer belt 30 onto the sheet P conveyed from the secondary transfer nip. The conveyance path R is further provided with the output roller pair 13 located above the fixing device 20, that is, downstream from the fixing device 20 in the sheet conveyance direction A1. The output roller pair 13 discharges the sheet P bearing the fixed toner image onto the outside of the image forming apparatus 1, that is, an output tray 14 disposed atop the image forming apparatus 1. The output tray 14 stocks the sheet P discharged by the output roller pair 13.

With reference to FIG. 1, a description is provided of an image forming operation performed by the image forming apparatus 1 having the construction described above to form a color toner image on a sheet P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

As the yellow, magenta, cyan, and black toner images constituting the color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the color toner image is conveyed to the fixing device 20 that fixes the color toner image on the sheet P. Then, the sheet P bearing the fixed color toner image is discharged by the output roller pair 13 onto the outside of the image forming apparatus 1, that is, the output tray 14 that stocks the sheet P.

The above describes the image forming operation of the image forming apparatus 1 to form the color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
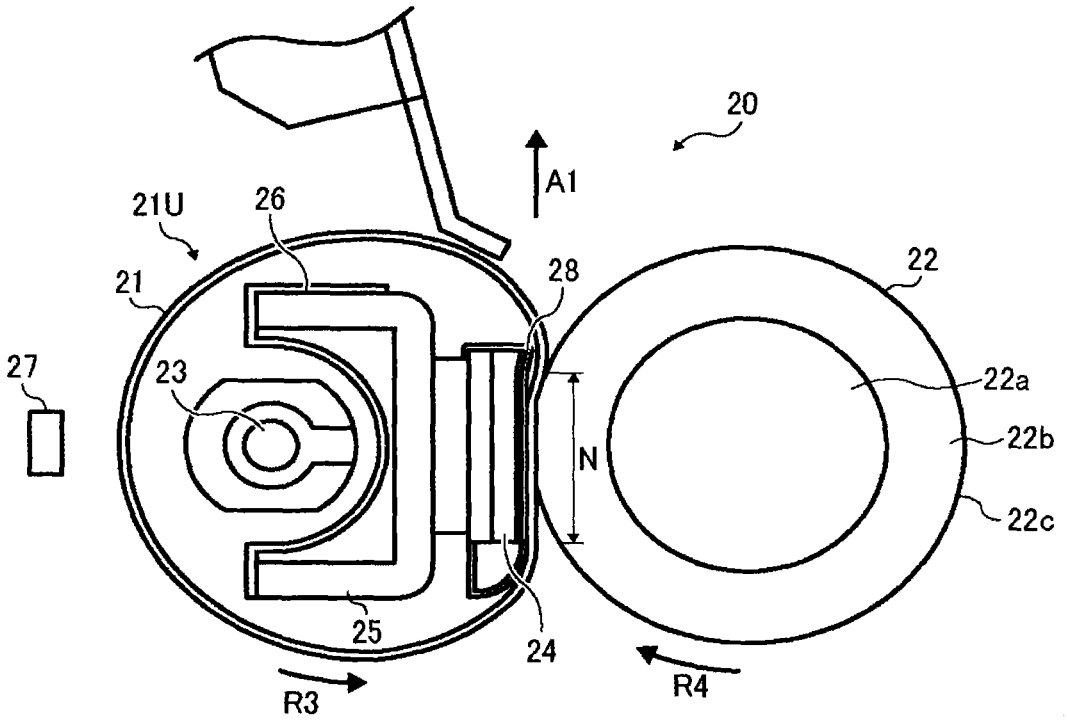
FIG. 2 is a vertical sectional view of a fixing device incorporated in the image forming apparatus shown in FIG. 1.

With reference to FIG. 2, a description is provided of a construction of the fixing device 20 according to a first exemplary embodiment that is incorporated in the image forming apparatus 1 described above.

FIG. 2 is a vertical sectional view of the fixing device 20. As shown in FIG. 2, the fixing device 20 (e.g., a fuser) includes a fixing belt 21 serving as a fixing rotator or an endless belt formed into a loop and rotatable in a rotation direction R3; a pressure roller 22 serving as an opposed rotator or a pressure rotator disposed opposite an outer circumferential surface of the fixing belt 21 to separably or unseparably contact the fixing belt 21 and rotatable in a rotation direction R4 counter to the rotation direction R3 of the fixing belt 21; a halogen heater 23 serving as a heater disposed inside the loop formed by the fixing belt 21 to heat the fixing belt 21; a nip formation pad 24 disposed inside the loop formed by the fixing belt 21 and pressing against the pressure roller 22 via the fixing belt 21 to form a fixing nip N between the fixing belt 21 and the pressure roller 22; a stay 25 serving as a support disposed inside the loop formed by the fixing belt 21 and contacting and supporting the nip formation pad 24; a reflector 26 disposed inside the loop formed by the fixing belt 21 to reflect light radiated from the halogen heater 23 toward the fixing belt 21; and a temperature sensor 27 serving as a temperature detector disposed opposite the outer circumferential surface of the fixing belt 21 to detect the temperature of the fixing belt 21. The fixing belt 21 and the components disposed inside the loop formed by the fixing belt 21, that is, the halogen heater 23, the nip formation pad 24, the stay 25, and the reflector 26, may constitute a belt unit 21U separably coupled with the pressure roller 22.

A detailed description is now given of a construction of the fixing belt 21.

The fixing belt 21 is a thin, flexible endless belt or film.

A detailed description is now given of a construction of the pressure roller 22.

The pressure roller 22 is constructed of a metal core 22*a*, an elastic layer 22*b* coating the metal core 22*a*, and a release layer 22*c* coating the elastic layer 22*b*. A pressurization assembly presses the pressure roller 22 against the nip formation pad 24 via the fixing belt 21 to form the fixing nip N between the fixing belt 21 and the pressure roller 22 that has a predetermined length in the sheet conveyance direction A1. A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

A detailed description is now given of a configuration of the halogen heater 23.

The power supply situated inside the image forming apparatus 1 supplies power to the halogen heater 23 so that the halogen heater 23 heats the fixing belt 21. A controller (e.g., a processor), that is, a central processing unit (CPU) provided with a random-access memory (RAM) and a read-only memory (ROM), for example, operatively connected to the halogen heater 23 and the temperature sensor 27 controls the halogen heater 23 based on the temperature of the outer circumferential surface of the fixing belt 21 detected by the temperature sensor 27 so as to adjust the temperature of the fixing belt 21 to a desired fixing temperature.

FIG. 2 illustrates the halogen heater 23 disposed opposite an inner circumferential surface of the fixing belt 21 and serving as a heater for heating the fixing belt 21 as one example. Alternatively, instead of the halogen heater 23, an induction heater (IH) including an IH coil, a resistance heat generator, a carbon heater, or the like may be employed as a heater that heats the fixing belt 21. A bulge 28 projects from a downstream end of the nip formation pad 24 in the sheet conveyance direction A1 toward the pressure roller 22. The bulge 28 does not press against the pressure roller 22 via the fixing belt 21 and therefore is not produced by contact with the pressure roller 22. The bulge 28 lifts the sheet P conveyed through an exit of the fixing nip N from the fixing belt 21, facilitating separation of the sheet P from the fixing belt 21.

Figure 3:
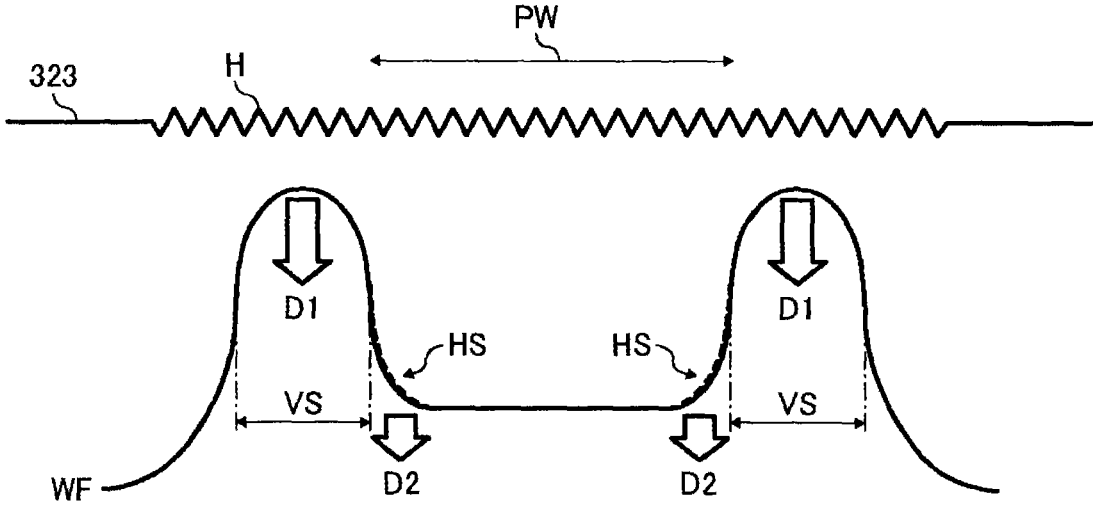
FIG. 3 is a schematic diagram of a halogen heater installable in the fixing device shown in FIG. 2.

With reference to FIG. 3, a description is provided of overheating of each lateral end of the fixing belt 21 in an axial direction thereof and resultant hot offset that may occur in a proximate region in proximity to a lateral edge of the sheet P in a width direction thereof parallel to the axial direction of the fixing belt 21.

FIG. 3 is a schematic diagram of a halogen heater 323 serving as a heater installable in the fixing device 20 depicted in FIG. 2. As shown in FIG. 3, the halogen heater 323 extends horizontally in FIG. 3 in the width direction of the sheet P. The halogen heater 323 has a heat generation span H in a longitudinal direction thereof parallel to the axial direction of the fixing belt 21. The heat generation span H corresponds to a width of a maximum sheet P in the axial direction of the fixing belt 21 that is available in the image forming apparatus 1. Taking a small sheet P, that is, an A6 size sheet, for example, the heat generation span H of the halogen heater 323 is greater than a width PW of the A6 size sheet in a width direction thereof parallel to the axial direction of the fixing belt 21. Accordingly, when a plurality of A6 size sheets is conveyed over the fixing belt 21 continuously, the A6 size sheets do not draw heat from each non-conveyance span of the fixing belt 21 outboard from the width PW of the A6 size sheet in the axial direction of the fixing belt 21. Consequently, the fixing belt 21 overheats in an overheating span VS in each non-conveyance span where the A6 size sheet is not conveyed as shown by a temperature waveform WF of the fixing belt 21 in FIG. 3. Thus, overheating occurs in each lateral end of the fixing belt 21 in the axial direction thereof.

Hence, when a plurality of small sheets P is conveyed through the fixing nip N continuously, the fixing belt 21 and the pressure roller 22 may overheat to a temperature above a heat resistant temperature of the fixing belt 21 and the pressure roller 22. Accordingly, in order to protect the fixing belt 21 and the pressure roller 22, it may be necessary to suppress temperature increase of the non-conveyance span of the fixing belt 21 where the small sheets P are not conveyed, resulting in degradation of productivity, that is, decrease in the number of copies per minute, in conveyance of the sheets P.

As the fixing belt 21 overheats in the non-conveyance span outboard from the width PW of the A6 size sheet, each lateral end of the A6 size sheet in the width direction thereof in proximity to each lateral edge of the A6 size sheet may also overheat, causing hot offset of toner of the toner image on the A6 size sheet. For example, hot offset occurs in a hot offset span HS indicated by the dotted line in FIG. 3 along the temperature waveform WF of the fixing belt 21. In order to suppress hot offset, it is necessary to suppress overheating of the fixing belt 21 in the non-conveyance span thereof. It is necessary to suppress overheating of the fixing belt 21 also in a portion thereof disposed opposite each lateral end of the A6 size sheet in the width direction thereof. However, since the A6 size sheet draws heat from a conveyance span of the fixing belt 21 in the axial direction thereof where the A6 size sheet is conveyed, overheating of the fixing belt 21 need to be suppressed in the conveyance span less than in the non-conveyance span. The amount of temperature decrease needed to prevent hot offset is indicated by downward wide arrows D1 and D2. A length of the arrow D2 situated in each lateral end of the conveyance span in the axial direction of the fixing belt 21 being smaller than a length of the arrow D1 situated in each non-conveyance span shows that the amount of temperature decrease needed in the conveyance span is smaller than the amount of temperature decrease needed in the non-conveyance span.

A description is provided of a configuration and an operation of the fixing device 20 incorporating the nip formation pad 24 as a first example to prevent overheating of each lateral end of the fixing belt 21 in the axial direction thereof and resultant hot offset of toner of the toner image in each lateral end of the sheet P in the axial direction of the fixing belt 21 in proximity to a lateral edge PE of the sheet P.

Figure 4:
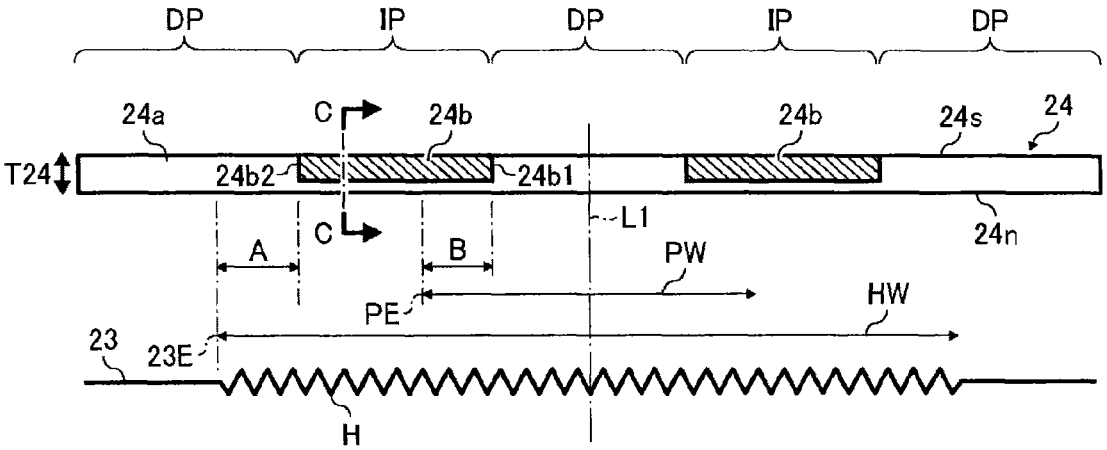
FIG. 4 is a schematic horizontal sectional view of a nip formation pad and the halogen heater incorporated in the fixing device shown in FIG. 2.

First, with reference to FIG. 4, a description is provided of the configuration of the fixing device 20 to prevent overheating of the fixing belt 21.

FIG. 4 is a schematic horizontal sectional view of the nip formation pad 24 and the halogen heater 23 incorporated in the fixing device 20 depicted in FIG. 2. FIG. 4 illustrates the nip formation pad 24 and the halogen heater 23 seen from the sheet conveyance direction A1. A horizontal direction in FIG. 4 is the width direction of the A6 size sheet perpendicular to the sheet conveyance direction A1. The sheet conveyance direction A1 is perpendicular to the drawing sheet on which FIG. 4 is illustrated. FIG. 4 illustrates a downstream cross-section of the nip formation pad 24 and the halogen heater 23 in the sheet conveyance direction A1. A thickness direction defines a direction perpendicular to the width direction of the sheet P and the sheet conveyance direction A1. In FIG. 4, the thickness direction extends vertically. The thickness direction of the nip formation pad 24 is indicated by a thickness direction T24.

The nip formation pad 24 is constructed of a plurality of components: a base 24*a* serving as a first member or a first thermal conductor and an increased thermal conductivity conductor 24*b*, that is, a high thermal conductivity conductor, serving as a second member or a second thermal conductor. As shown in FIG. 4, the nip formation pad 24 includes two increased thermal conductivity conductors 24*b* symmetrical with each other via a center line L1 in a longitudinal direction of the nip formation pad 24 parallel to the axial direction of the fixing belt 21. The sheet P is centered on the center line L1 serving as a sheet alignment reference such that a center of the sheet P in the width direction thereof overlaps the center line L1.

The increased thermal conductivity conductor 24*b* does not reach a nip face 24*n*, that is, a lower face in FIG. 4, disposed opposite the fixing nip N and therefore is not exposed from the nip face 24*n*. Conversely, the base 24*a* is layered on the increased thermal conductivity conductor 24*b* and constitutes the nip face 24*n*. Accordingly, the nip formation pad 24 is constructed of a plurality of components: the base 24*a* and the increased thermal conductivity conductor 24*b*. A thermal conductivity of the base 24*a* is different from that of the increased thermal conductivity conductor 24*b*. For example, the thermal conductivity of the increased thermal conductivity conductor 24*b* is greater than that of the base 24*a*. Thus, the nip formation pad 24 includes an increased thermal conduction portion IP and a decreased thermal conduction portion DP. The decreased thermal conduction portion DP includes a single component, that is, the base 24*a*. Contrarily, the increased thermal conduction portion IP includes a plurality of components having different thermal conductivities, respectively: the base 24*a* and the increased thermal conductivity conductor 24*b* layered on the base 24*a* in the thickness direction T24 of the nip formation pad 24.

A total thermal conductivity in the thickness direction T24, that is, vertically in FIG. 4, of the nip formation pad 24 in the increased thermal conduction portion IP including the increased thermal conductivity conductor 24*b* having an increased thermal conductivity is greater than a thermal conductivity of the decreased thermal conduction portion DP including the base 24*a* but not including the increased thermal conductivity conductor 24*b*. The increased thermal conduction portion IP including the increased thermal conductivity conductor 24*b* absorbs heat from the fixing belt 21 depicted in FIG. 2 readily. Even if the fixing belt 21 overheats at a portion disposed opposite the increased thermal conduction portion IP, the increased thermal conduction portion IP absorbs heat from the fixing belt 21 and conducts heat in the thickness direction T24 of the nip formation pad 24, that is, upward in FIG. 4, thus suppressing overheating of the fixing belt 21.

Figure 5:
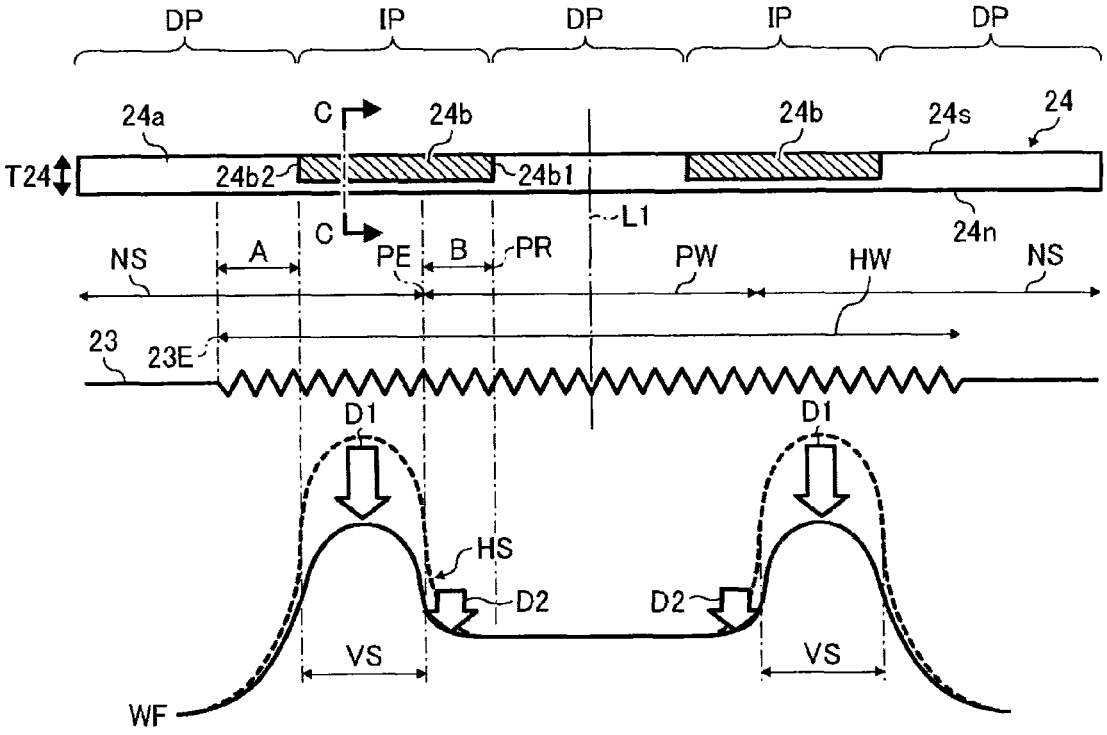
FIG. 5 is a schematic horizontal sectional view of the nip formation pad and the halogen heater shown in FIG. 4 illustrating a temperature waveform of a fixing belt incorporated in the fixing device shown in FIG. 2.

Next, with reference to FIG. 5, a description is provided of the operation of the fixing device 20 to prevent overheating of the fixing belt 21.

FIG. 5 is a schematic horizontal sectional view of the nip formation pad 24 and the halogen heater 23 illustrating the temperature waveform WF of the fixing belt 21. As shown in FIG. 5, as a plurality of small sheets P, that is, A6 size sheets having the width PW, is conveyed over the fixing belt 21 of a comparative fixing device that does not incorporate the nip formation pad 24 depicted in FIGS. 4 and 5, the fixing belt 21 may overheat substantially in each non-conveyance span NS of the fixing belt 21 disposed opposite each lateral end of the halogen heater 23 in a longitudinal direction thereof parallel to the axial direction of the fixing belt 21 as indicated by the dotted line of the temperature waveform WF of the fixing belt 21. To address this circumstance, the fixing device 20 according to this exemplary embodiment includes the increased thermal conductivity conductor 24*b* having an increased thermal conductivity disposed opposite an overheating portion of the fixing belt 21 that is susceptible to overheating. The increased thermal conductivity conductor 24*b* absorbs heat from the fixing belt 21 in the thickness direction T24 of the nip formation pad 24, that is, upward in FIG. 5, preventing overheating of the fixing belt 21 contacting the nip face 24*n* of the nip formation pad 24. Accordingly, overheating of the non-conveyance span NS of the fixing belt 21 is reduced as shown by the solid line of the temperature waveform WF of the fixing belt 21, preventing hot offset of toner of the toner image on the small sheet P at each lateral end in the width direction thereof.

A detailed description is now given of location of the increased thermal conductivity conductor 24*b* having an increased thermal conductivity in the longitudinal direction of the nip formation pad 24, that is, a horizontal direction in FIGS. 4 and 5 perpendicular to the sheet conveyance direction A1.

As shown in FIGS. 4 and 5, the increased thermal conductivity conductor 24*b* is positioned in the longitudinal direction of the nip formation pad 24 such that an outboard edge 24*b*2 of the increased thermal conductivity conductor 24*b* is inboard from a lateral edge 23E of the heat generation span H having a heating width HW of the halogen heater 23 by a distance A toward the center line L1. An inboard edge 24*b*1 of the increased thermal conductivity conductor 24*b* is inboard from the lateral edge PE of the small sheet P (e.g., an A6 size sheet according to this exemplary embodiment) by a distance B toward the center line L1. Since the increased thermal conduction portion IP including the increased thermal conductivity conductor 24*b* located as described above and therefore having an increased thermal conductivity is disposed opposite the overheating portion of the fixing belt 21 that is susceptible to overheating indicated by the dotted temperature waveform WF of the fixing belt 21 drawing a high mountain, the increased thermal conductivity conductor 24*b* absorbs heat from the overheating portion of the fixing belt 21 effectively, preventing overheating of each lateral end of the fixing belt 21 in the axial direction thereof.

Additionally, since the inboard edge 24*b*1 of the increased thermal conductivity conductor 24*b* is inboard from the lateral edge PE of the small sheet P by the distance B toward the center line L1, a lateral end of the small sheet P overlaps the increased thermal conductivity conductor 24*b*. Accordingly, the increased thermal conductivity conductor 24*b* absorbs heat from the fixing belt 21 in the hot offset span HS within the distance B depicted in FIG. 5 that is susceptible to adverse affection from overheating in the non-conveyance span NS of the fixing belt 21, preventing overheating of the fixing belt 21 at a position in proximity to the lateral edge PE of the small sheet P in the width direction thereof. Consequently, even when a plurality of small sheets P is conveyed over the fixing belt 21 continuously, hot offset does not occur in toner of the toner image formed on the lateral end of the small sheet P in proximity to the lateral edge PE of the sheet P, preventing formation of a faulty toner image and achieving high quality fixing.

A span from the inboard edge 24*b*1 of the increased thermal conductivity conductor 24*b* to the center line L1 in the axial direction of the fixing belt 21 defines the decreased thermal conduction portion DP. According to this exemplary embodiment, the sheet P conveyed over the fixing belt 21 is centered in the axial direction of the fixing belt 21. Hence, as shown in FIGS. 4 and 5, the increased thermal conductivity conductors 24*b* are symmetric with each other via the center line L1. For example, the increased thermal conductivity conductors 24*b* constituting the increased thermal conduction portions IP and being symmetric with each other about the center line L1 sandwich the decreased thermal conduction portion DP in the longitudinal direction of the nip formation pad 24, defining the center decreased thermal conduction portion DP in the longitudinal direction of the nip formation pad 24. Since the increased thermal conduction portions IP including the increased thermal conductivity conductors 24*b* are situated outboard from the center decreased thermal conduction portion DP in the longitudinal direction of the nip formation pad 24, the increased thermal conduction portions IP do not absorb heat from the fixing belt 21 unnecessarily when the sheet P is conveyed over the fixing belt 21.

A detailed description is now given of the material, shape, and surface property of the nip formation pad 24.

First, a description is provided of the material of the nip formation pad 24.

For example, the increased thermal conductivity conductor 24*b* constituting the increased thermal conduction portion IP is made of carbon nanotube having a thermal conductivity in a range of from about 3,000 [W/mK] to about 5,500 [W/mK]; graphite sheet having a thermal conductivity in a range of from about 700 [W/mK] to about 1,750 [W/mK]; silver having a thermal conductivity of about 420 [W/mK]; copper having a thermal conductivity of about 398 [W/mK]; and/or aluminum having a thermal conductivity of about 236 [W/mK].

The base 24*a* constituting the decreased thermal conduction portion DP is made of heat resistant resin having an increased thermal resistance and a sufficient mechanical strength against pressure from the pressure roller 22 even under high temperature. For example, the base 24*a* is made of polyphenylene sulfide (PPS) having a thermal conductivity of about 0.20 [W/mK], polyether ether ketone (PEEK) having a thermal conductivity of about 0.26 [W/mK], poly ether ketone (PEK) having a thermal conductivity of about 0.29 [W/mK], polyamide imide (PAI) having a thermal conductivity in a range of from about 0.29 [W/mK] to about 0.60 [W/mK], and/or liquid crystal polymer (LCP) having a thermal conductivity in a range of from about 0.38 [W/mK] to about 0.56 [W/mK].

Next, a description is provided of the shape of the nip formation pad 24.

As shown in FIG. 2, the nip formation pad 24 situated inside the loop formed by the fixing belt 21 contacts the inner circumferential surface of the fixing belt 21 as the fixing belt 21 slides over the nip formation pad 24. Since the nip formation pad 24 is constantly exerted with predetermined pressure or more from the pressure roller 22 via the fixing belt 21, the nip formation pad 24 adheres to the fixing belt 21 sufficiently and receives heat from the fixing belt 21 readily. The nip formation pad 24 has a thickness in a range of from about 1 mm to about 10 mm that increases the cross-sectional area of the nip formation pad 24, thus increasing an amount of heat conducted in the longitudinal direction of the nip formation pad 24 perpendicular to the sheet conveyance direction A1 and parallel to the axial direction of the fixing belt 21.

In order to even the temperature of the fixing belt 21 in the axial direction thereof parallel to the width direction of the sheet P, the increased thermal conductivity conductor 24*b* does not expose from the nip face 24*n* of the nip formation pad 24 over which the fixing belt 21 slides. For example, as shown in FIGS. 4 and 5, the base 24*a* is interposed between the increased thermal conductivity conductor 24*b* and the fixing belt 21. Thus, the nip formation pad 24 prevents variation in temperature of the fixing belt 21 in the axial direction thereof.

Next, a description is provided of the surface property of the nip formation pad 24.

In order to prioritize equalization of heat in the axial direction of the fixing belt 21, the nip formation pad 24 is made of a conductive material and the nip face 24*n* of the nip formation pad 24 has a smooth surface with a surface roughness not greater than a surface roughness of the inner circumferential surface of the fixing belt 21, thus facilitating adhesion of the nip formation pad 24 to the fixing belt 21. If surface asperities of the nip formation pad 24 produce a space between the nip formation pad 24 and the fixing belt 21, air in the space may insulate the nip formation pad 24 from the fixing belt 21, obstructing conduction of heat from the fixing belt 21 to the nip formation pad 24 substantially.

Alternatively, the nip face 24*n* of the nip formation pad 24 that contacts the fixing belt 21 may be coated with fluoroplastic, such as tetrafluoroethylene-perfluoroalkylvinylether copolymer (PFA), polytetrafluoroethylene (PTFE), and ethylene tetrafluoroethylene (ETFE), having a thickness in a range of from about 5 micrometers to about 50 micrometers to facilitate sliding of the fixing belt 21 over the nip formation pad 24. However, since the thermal conductivity of the fluoroplastic is smaller than that of the conductive material described above, the thickness and employment of the fluoroplastic may be determined properly. Yet alternatively, in order to facilitate sliding of the fixing belt 21 over the nip formation pad 24 further, the nip face 24*n* of the nip formation pad 24 may be applied with a lubricant such as silicone oil, silicone grease, and fluorine grease. In order to facilitate sliding of the fixing belt 21 over the nip formation pad 24 further, the nip face 24*n* of the nip formation pad 24 may be coated with a slide sheet manufactured by weaving PTFE or PFA fiber into a sheet. Alternatively, the slide sheet may be manufactured by coating a thin resin base with PFA or PTFE or by braiding glass cloth into a base.

A description is provided of a configuration of the increased thermal conductivity conductor 24*b* of the nip formation pad 24.

As shown in FIG. 4, the outboard edge 24*b*2 of the increased thermal conductivity conductor 24*b* situated outboard from the inboard edge 24*b*1 and the center line L1 in the longitudinal direction of the nip formation pad 24 is situated inboard from the lateral edge 23E of the heat generation span H having the heating width HW, that is, an outboard edge, of the halogen heater 23 by the distance A toward the center line L1. In other words, the lateral edge 23E of the heat generation span H of the halogen heater 23 is outboard from the outboard edge 24*b*2 of the increased thermal conductivity conductor 24*b* by the distance A in the longitudinal direction of the nip formation pad 24. That is, the lateral edge 23E of the heat generation span H of the halogen heater 23 is spaced apart from the center line L1 farther than the outboard edge 24*b*2 of the increased thermal conductivity conductor 24*b* in the longitudinal direction of the nip formation pad 24.

As shown by the temperature wavelength WF of the fixing belt 21 in FIG. 5, it is difficult for each outermost end of the halogen heater 23 in the longitudinal direction thereof to heat the fixing belt 21 to a desired temperature compared to a center of the halogen heater 23 in the longitudinal direction thereof, decreasing the temperature of each lateral end of the fixing belt 21 in the axial direction thereof. It is because a length of the fixing belt 21 in the axial direction thereof is greater than the heating width HW of the halogen heater 23. Accordingly, it is not necessary to locate the outboard edge 24*b*2 of the increased thermal conductivity conductor 24*b* outboard from the outermost end of the halogen heater 23 in the longitudinal direction thereof at a position spaced apart from the center line L1 than the outermost end of the halogen heater 23. Consequently, even if the outboard edge 24*b*2 of the increased thermal conductivity conductor 24*b* is situated inboard from the lateral edge 23E of the heat generation span H of the halogen heater 23 in the longitudinal direction thereof by the distance A, the increased thermal conductivity conductor 24*b* suppresses overheating of the lateral end of the fixing belt 21 in the axial direction thereof.

If the outboard edge 24*b*2 of the increased thermal conductivity conductor 24*b* is situated outboard from the lateral edge 23E of the heat generation span H of the halogen heater 23 in the longitudinal direction thereof at a position spaced apart from the center line L1 than the lateral edge 23E of the heat generation span H, the increased thermal conductivity conductor 24*b* may absorb heat from the fixing belt 21 unnecessarily, wasting energy. To address this circumstance, the width of the increased thermal conductivity conductor 24*b* in the longitudinal direction of the nip formation pad 24 is determined to a width that is necessary and sufficient so that the outboard edge 24*b*2 of the increased thermal conductivity conductor 24*b* is situated inboard from the lateral edge 23E of the heat generation span H of the halogen heater 23 by the distance A in the longitudinal direction of the nip formation pad 24. The base 24*a* having a decreased thermal conductivity constitutes a lateral end of the nip formation pad 24 disposed outboard from the heat generation span H of the halogen heater 23 having the heating width HW where the halogen heater 23 heats the fixing belt 21 in the longitudinal direction of the halogen heater 23. Thus, the nip formation pad 24 suppresses unnecessary absorption of heat from the fixing belt 21, saving energy.

As described above, the increased thermal conductivity conductor 24*b* does not expose from the nip face 24*n*, that is, a lower face in FIG. 4, of the nip formation pad 24. That is, the base 24*a* is interposed between the increased thermal conductivity conductor 24*b* and the fixing belt 21 to prohibit the increased thermal conductivity conductor 24*b* from contacting the fixing belt 21. Since the base 24*a* extends on the nip face 24*n* throughout the entire width in the longitudinal direction of the nip formation pad 24, when the fixing belt 21 heated quickly comes into contact with the base 24*a*, the base 24*a* suppresses heat conduction from the fixing belt 21 to the nip formation pad 24 compared to a configuration in which the fixing belt 21 contacts the increased thermal conductivity conductor 24*b*. Thus, the base 24*a* reduces variation in temperature of the fixing belt 21 in the axial direction thereof parallel to the width direction of the sheet P.

If the increased thermal conductivity conductor 24*b* exposes from the nip face 24*n* and contacts the fixing belt 21, an increased amount of heat conducts from the fixing belt 21 to the increased thermal conduction portion IP incorporating the increased thermal conductivity conductor 24*b* having an increased thermal conductivity, causing substantial variation in temperature of the fixing belt 21 in the axial direction thereof. Accordingly, a portion of the fixing belt 21 that suffers from substantial temperature decrease may not be heated to a desired fixing temperature, causing faulty fixing resulting in faulty image formation on the sheet P.

As described above, the increased thermal conductivity conductor 24*b* is made of a material having an increased thermal conductivity and being manufactured at reduced costs, such as copper and aluminum. Conversely, the base 24*a* is made of a heat resistant material having a decreased thermal conductivity, for example, heat resistant resin such as PPS, PAI, PEEK, PEK, and LCP.

Figure 6A:
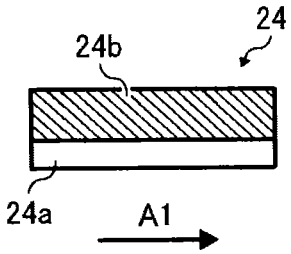
FIG. 6A is a sectional view of the nip formation pad taken on line C-C in FIG. 4 as a first example.
Figure 6B:
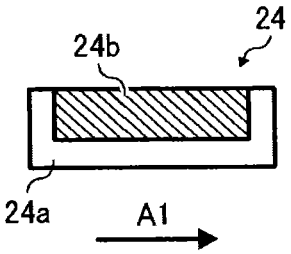
FIG. 6B is a sectional view of the nip formation pad taken on line C-C in FIG. 4 as a second example.
Figure 6C:
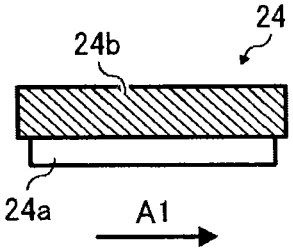
FIG. 6C is a sectional view of the nip formation pad taken on line C-C in FIG. 4 as a third example.

With reference to FIGS. 6A, 6B, and 6C, a description is provided of three examples of layering of the increased thermal conductivity conductor 24*b* on the base 24*a*.

FIGS. 6A, 6B, and 6C illustrate the nip formation pad 24 seen from the axial direction of the fixing belt 21. A rightward horizontal direction in FIGS. 6A, 6B, and 6C is the sheet conveyance direction A1 perpendicular to the longitudinal direction of the nip formation pad 24. FIG. 6A is a sectional view of the nip formation pad 24 taken on line C-C in FIG. 4 as a first example. FIG. 6B is a sectional view of the nip formation pad 24 taken on line C-C in FIG. 4 as a second example. FIG. 6C is a sectional view of the nip formation pad 24 taken on line C-C in FIG. 4 as a third example.

FIG. 6A illustrates the nip formation pad 24 including the base 24*a* and the increased thermal conductivity conductor 24*b* that have an identical length in the sheet conveyance direction A1. According to the exemplary embodiment described above, the nip formation pad 24 shown in FIG. 6A is employed.

FIG. 6B illustrates the nip formation pad 24 in which a length of the increased thermal conductivity conductor 24*b* in the sheet conveyance direction A1 is smaller than that of the base 24*a*. FIG. 6C illustrates the nip formation pad 24 in which a length of the increased thermal conductivity conductor 24*b* in the sheet conveyance direction A1 is greater than that of the base 24*a*.

As shown in FIGS. 6A, 6B, and 6C, the thickness of the base 24*a* and the increased thermal conductivity conductor 24*b* is determined such that the decreased thermal conduction portions DP and the increased thermal conduction portions IP create a planar opposite face 24*s* opposite the nip face 24*n*, that is, an upper face of the nip formation pad 24 depicted in FIG. 4. Alternatively, the increased thermal conductivity conductor 24*b* may project from the base 24*a* toward the stay 25 depicted in FIG. 2 such that the decreased thermal conduction portions DP and the increased thermal conduction portions IP create an uneven opposite face opposite the nip face 24*n*.

Incidentally, instead of the halogen heater 23 depicted in FIG. 2, an induction heater may be employed as a heater that heats the fixing belt 21. For example, a driver changes a heat generation span of the induction heater in a longitudinal direction thereof according to the size of the sheet P, suppressing overheating of the non-conveyance span NS of the fixing belt 21 where the sheet P is not conveyed. However, the driver that changes the heat generation span of the induction heater may increase manufacturing costs. To address this circumstance, according to the exemplary embodiments described above, the nip formation pad 24 is constructed of a plurality of components, that is, the base 24*a* and the increased thermal conductivity conductor 24*b*, suppressing overheating of both lateral ends of the fixing belt 21 in the axial direction thereof where the sheet P is not conveyed. Accordingly, even if the fixing device 20 employs the induction heater as a heater that heats the fixing belt 21, the driver that changes the heat generation span of the induction heater is not needed, decreasing the number of parts installed in the fixing device 20 and therefore achieving the simple fixing device 20 manufactured at reduced costs.

Figure 7:
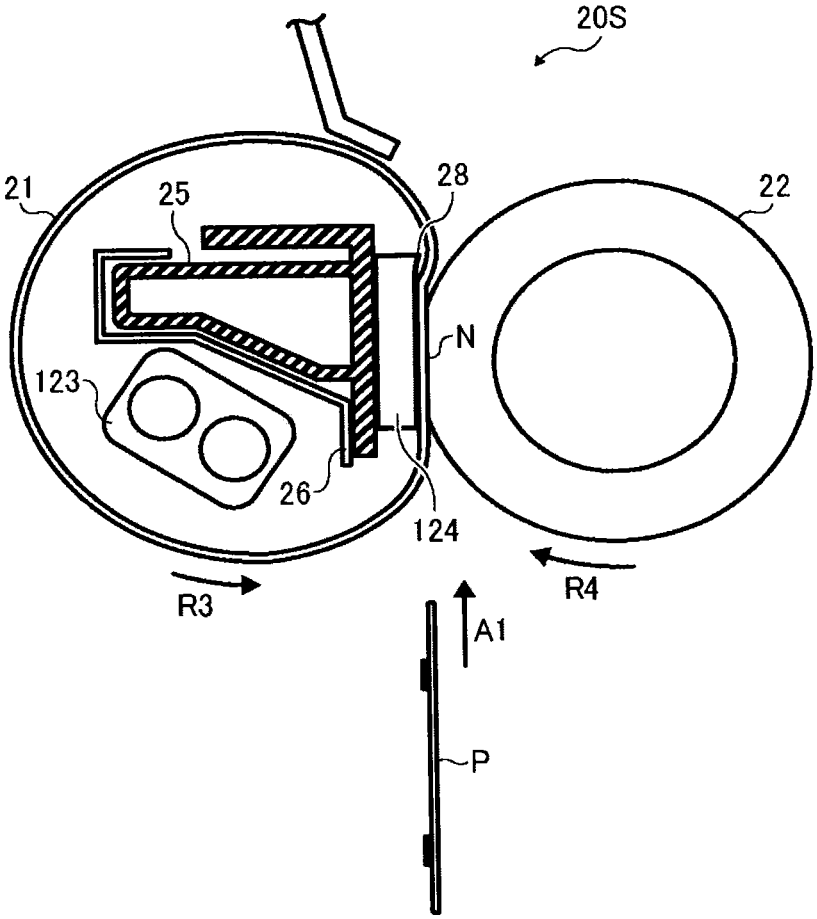
FIG. 7 is a vertical sectional view of a fixing device according to a second exemplary embodiment.
Figure 8:
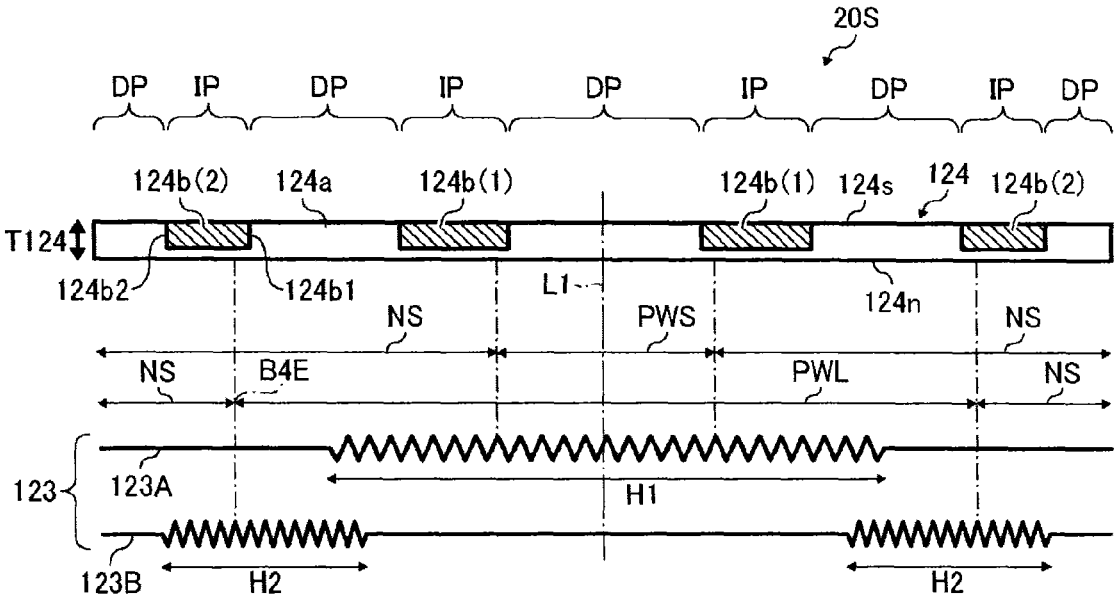
FIG. 8 is a horizontal sectional view of the fixing device shown in FIG. 7.

With reference to FIGS. 7 and 8, a description is provided of a construction of a fixing device 20S according to a second exemplary embodiment.

FIG. 7 is a vertical sectional view of the fixing device 20S. FIG. 8 is a horizontal sectional view of the fixing device 20S. As shown in FIGS. 7 and 8, the fixing device 20S includes a plurality of halogen heaters, serving as a heater for heating the fixing belt 21, that has different heat generation spans in the axial direction of the fixing belt 21. Identical reference numerals are assigned to components identical or equivalent to the components incorporated in the fixing device 20 shown in FIG. 2.

As shown in FIG. 7, the fixing device 20S includes a plurality of halogen heaters serving as a heater for heating the fixing belt 21, that is, a halogen heater pair 123. As shown in FIG. 8, the halogen heater pair 123 includes a first heater 123A and a second heater 123B having a plurality of heat generation spans different from each other to heat the fixing belt 21 in various heating spans corresponding to various widths of sheets P in the axial direction of the fixing belt 21, respectively. As shown in FIG. 7, the fixing device 20S includes a nip formation pad 124 pressing against the pressure roller 22 via the fixing belt 21 to form the fixing nip N between the fixing belt 21 and the pressure roller 22. Like the fixing device 20 shown in FIG. 2, the fixing device 20S shown in FIG. 7 includes the bulge 28 projecting from a downstream end of the nip formation pad 124 in proximity to the exit of the fixing nip N toward the pressure roller 22. The bulge 28 does not press against the pressure roller 22 via the fixing belt 21 and therefore is not produced by contact with the pressure roller 22. The bulge 28 facilitates separation of a sheet P from the fixing belt 21.

Except for the number of the halogen heaters and a configuration of the nip formation pad 124 described below, the construction of the fixing device 20S is equivalent to that of the fixing device 20 depicted in FIG. 2. Hence, redundant description is omitted and difference from the fixing device 20 is explained below.

With reference to FIG. 8, a description is provided of a configuration of the nip formation pad 124 as a second example.

FIG. 8 is a schematic horizontal sectional view of the nip formation pad 124 and the halogen heater pair 123 incorporated in the fixing device 20S depicted in FIG. 7. FIG. 8 illustrates the nip formation pad 124 and the halogen heater pair 123 seen from the sheet conveyance direction A1. A horizontal direction in FIG. 8 is the width direction of the sheet P perpendicular to the sheet conveyance direction A1. The sheet conveyance direction A1 is perpendicular to the drawing sheet on which FIG. 8 is illustrated. FIG. 8 illustrates a downstream cross-section of the nip formation pad 124 and the halogen heater pair 123 in the sheet conveyance direction A1. In FIG. 8, the thickness direction extends vertically. The thickness direction of the nip formation pad 124 is indicated by a thickness direction T124.

As shown in FIG. 8, the halogen heater pair 123 is constructed of two heaters having different heat generation spans in a longitudinal direction thereof parallel to the axial direction of the fixing belt 21, that is, the first heater 123A having a first heat generation span H1 corresponding to the width of a small sheet P (e.g., an A6 size sheet having a width PWS) and the second heater 123B having a second heat generation span H2 corresponding to the width of a large sheet P (e.g., a B4 size sheet having a width PWL). The second heater 123B has no heat generation span at a center thereof in the longitudinal direction of the halogen heater pair 123 but has the second heat generation span H2 at each lateral end in the longitudinal direction of the halogen heater pair 123.

In the fixing device 20S incorporating the plurality of heaters having different heat generation spans in the width direction of the sheet P, the halogen heater pair 123 is controlled to change the number of heaters to be turned on according to the size of the sheet P conveyed over the fixing belt 21. For example, as a B4 size sheet is conveyed over the fixing belt 21, since the first heater 123A has the first heat generation span H1 smaller than the width PWL of the B4 size sheet, the second heater 123B as well as the first heater 123A is turned on to attain a combined heat generation span combining the first heat generation span H1 and both second heat generation spans H2 that is greater than the width PWL of the B4 size sheet. However, since each second heat generation span H2 of the second heater 123B extends outboard from each lateral edge B4E of the B4 size sheet in a width direction thereof, the second heater 123B heats the non-conveyance span NS of the fixing belt 21 where the B4 size sheet is not conveyed, overheating each lateral end of the fixing belt 21 in the axial direction thereof. In order to prevent overheating of the fixing belt 21, the fixing device 20S includes a secondary increased thermal conductivity conductor described below.

As shown in FIG. 4, the nip formation pad 24 of the fixing device 20 includes the single increased thermal conduction portion IP disposed in a first half section, that is, a left half section in FIG. 4, defined by the center line L1 in the longitudinal direction of the nip formation pad 24 and the single increased thermal conduction portion IP disposed in a second half section, that is, a right half section in FIG. 4, defined by the center line L1 in the longitudinal direction of the nip formation pad 24. The increased thermal conduction portion IP in the first half section is symmetrical with the increased thermal conduction portion IP in the second half section via the center line L1. Conversely, as shown in FIG. 8, the nip formation pad 124 of the fixing device 20S includes a plurality of increased thermal conduction portions IP, each of which includes a base 124*a* and an increased thermal conductivity conductor 124*b*, disposed in the first half section defined by the center line L1 in a longitudinal direction of the nip formation pad 124 and a plurality of increased thermal conduction portions IP disposed in the second half section defined by the center line L1 in the longitudinal direction of the nip formation pad 124. The two increased thermal conduction portions IP in the first half section are symmetrical with the two increased thermal conduction portions IP in the second half section via the center line L1. For example, the inboard increased thermal conduction portion IP serving as a primary increased thermal conduction portion in the first half section is symmetrical with the inboard increased thermal conduction portion IP serving as a primary increased thermal conduction portion in the second half section. The outboard increased thermal conduction portion IP serving as a secondary increased thermal conduction portion in the first half section is symmetrical with the outboard increased thermal conduction portion IP serving as a secondary increased thermal conduction portion in the second half section. Thus, the nip formation pad 124 includes the four increased thermal conduction portions IP.

The four increased thermal conduction portions IP include two inboard, first increased thermal conductivity conductors 124*b*(1) in proximity to the center line L1 and two outboard, second increased thermal conductivity conductors 124*b*(2) disposed outboard from the first increased thermal conductivity conductors 124*b*(1), respectively, in the longitudinal direction of the nip formation pad 124. The first increased thermal conductivity conductors 124*b*(1) are equivalent to the increased thermal conductivity conductors 24*b* depicted in FIG. 5. Since the position and operation of the first increased thermal conductivity conductor 124*b*(1) are equivalent to those of the increased thermal conductivity conductor 24*b*, redundant description is omitted.

Each of the outboard, second increased thermal conductivity conductors 124*b*(2) spaced apart from the center line L1 farther than the inboard, first increased thermal conductivity conductor 124*b*(1) is situated outboard from the first heat generation span H1 of the first heater 123A in the longitudinal direction of the nip formation pad 124 and disposed opposite the second heat generation span H2 of the second heater 123B. According to this exemplary embodiment, an inboard edge 124*b*1 of the second increased thermal conductivity conductor 124*b*(2) is inboard from the lateral edge B4E of a large sheet P, for example, the B4 size sheet having the width PWL, in the longitudinal direction of the nip formation pad 124 toward the center line L1.

The second increased thermal conductivity conductor 124*b*(2) is made of a material identical to a material of the first increased thermal conductivity conductor 124*b*(1) and the increased thermal conductivity conductor 24*b* depicted in FIG. 5, for example, copper, aluminum, or the like. Alternatively, the second increased thermal conductivity conductor 124*b*(2) may be made of a material different from a material of the first increased thermal conductivity conductor 124*b*(1). The second increased thermal conductivity conductor 124*b*(2) has a thickness identical to or different from that of the first increased thermal conductivity conductor 124*b*(1). The material and thickness of the first increased thermal conductivity conductor 124*b*(1) and the second increased thermal conductivity conductor 124*b*(2) are determined according to an amount of energy input from the halogen heater pair 123.

A distance from a nip face 124*n* of the nip formation pad 124 that contacts the fixing belt 21, that is, a lower face in FIG. 8, to the first increased thermal conductivity conductor 124*b*(1), that is, a thickness of the base 124*a* interposed between the nip face 124*n* and the first increased thermal conductivity conductor 124*b*(1) may be different from a distance from the nip face 124*n* to the second increased thermal conductivity conductor 124*b*(2), that is, a thickness of the base 124*a* interposed between the nip face 124*n* and the second increased thermal conductivity conductor 124*b* (2). If the thickness of the base 124*a* interposed between the nip face 124*n* and the first increased thermal conductivity conductor 124*b*(1) or the second increased thermal conductivity conductor 124*b*(2) is small, heat absorbed from the fixing belt 21 to the base 124*a* conducts to the first increased thermal conductivity conductor 124*b*(1) and the second increased thermal conductivity conductor 124*b*(2) quickly. Conversely, if the thickness of the base 124*a* interposed between the nip face 124*n* and the first increased thermal conductivity conductor 124*b*(1) or the second increased thermal conductivity conductor 124*b*(2) is great, heat absorbed from the fixing belt 21 to the base 124*a* conducts to the first increased thermal conductivity conductor 124*b*(1) and the second increased thermal conductivity conductor 124*b*(2) slowly. Hence, the amount of heat absorbed from the fixing belt 21 to the first increased thermal conductivity conductor 124*b*(1) and the second increased thermal conductivity conductor 124*b*(2) through the base 124*a* and the time taken for the first increased thermal conductivity conductor 124*b*(1) and the second increased thermal conductivity conductor 124*b*(2) to absorb heat from the fixing belt 21 through the base 124*a* are adjusted by changing the thickness of the base 124*a*. The thickness of the base 124*a* is determined according to an amount of energy input from the halogen heater pair 123.

Figure 9:
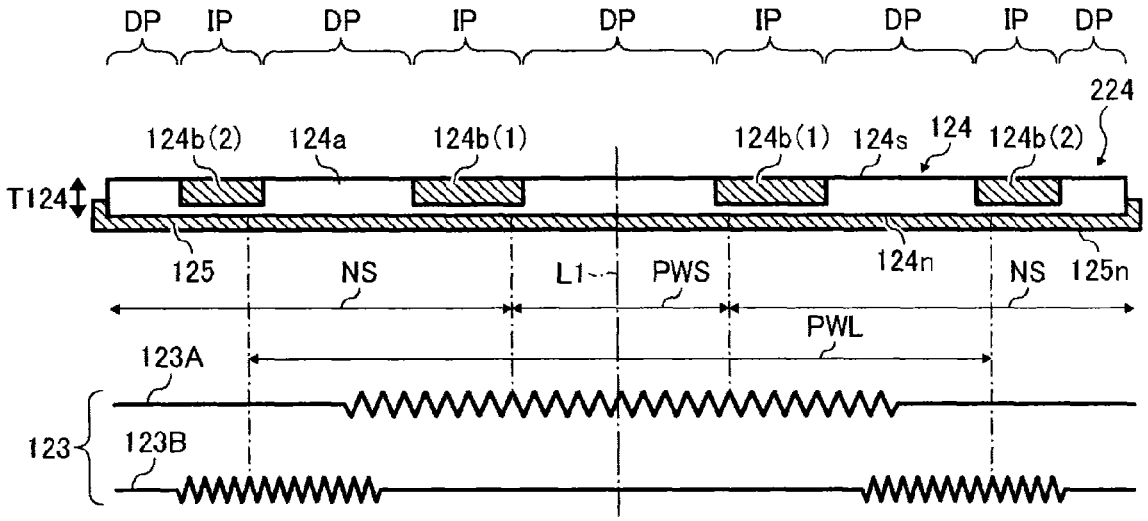
FIG. 9 is a schematic horizontal sectional view of a nip formation assembly and a halogen heater pair installable in the fixing device depicted in FIG. 7.

With reference to FIG. 9, a description is provided of a construction of a nip formation assembly 224 as a third example.

FIG. 9 is a schematic horizontal sectional view of the nip formation assembly 224 and the halogen heater pair 123 installable in the fixing device 20S depicted in FIG. 7. As shown in FIG. 9, the nip formation assembly 224 includes the nip formation pad 124 and an elongate increased thermal conductivity conductor 125. The nip face 124*n*, that is, the lower face in FIG. 9, of the nip formation pad 124 that is disposed opposite the fixing belt 21 at the fixing nip N mounts the elongate increased thermal conductivity conductor 125 extending throughout the entire width of the nip formation pad 124 in the longitudinal direction thereof parallel to the axial direction of the fixing belt 21. Except for the elongate increased thermal conductivity conductor 125, the construction of the nip formation assembly 224 is equivalent to that of the nip formation pad 124 depicted in FIG. 8. Hence, redundant description is omitted and difference from the nip formation pad 124 is explained below.

As shown in FIG. 9, the nip formation assembly 224 includes the elongate increased thermal conductivity conductor 125 mounted on the nip face 124*n* of the nip formation pad 124 depicted in FIG. 8 and extended throughout the entire width of the nip formation pad 124 in the longitudinal direction thereof. The elongate increased thermal conductivity conductor 125 facilitates conduction of heat in the longitudinal direction of the nip formation pad 124. The elongate increased thermal conductivity conductor 125 is disposed closer to the fixing belt 21 than the first increased thermal conductivity conductor 124*b*(1) and the second increased thermal conductivity conductor 124*b*(2). For example, the elongate increased thermal conductivity conductor 125 is in contact with or in proximity to the fixing belt 21 in the non-conveyance span NS thereof where a small sheet P (e.g., an A6 size sheet having the width PWS) is not conveyed that is susceptible to overheating. That is, the elongate increased thermal conductivity conductor 125 is disposed at a position where the elongate increased thermal conductivity conductor 125 absorbs heat from the overheating portion of the fixing belt 21 readily. The elongate increased thermal conductivity conductor 125 is made of a material having an increased thermal conductivity, for example, copper, aluminum, or the like. The elongate increased thermal conductivity conductor 125 is made of a material identical to or different from a material of the first increased thermal conductivity conductor 124*b*(1) or the second increased thermal conductivity conductor 124*b*(2).

As the inner circumferential surface of the fixing belt 21 directly slides over a nip face 125*n* of the elongate increased thermal conductivity conductor 125 that is disposed opposite the fixing nip N, a friction coefficient μ, between the fixing belt 21 and the elongate increased thermal conductivity conductor 125 may increase or the fixing belt 21 and the elongate increased thermal conductivity conductor 125 may not achieve sufficient durability against abrasion. To address this circumstance and reduce the friction coefficient t, the elongate increased thermal conductivity conductor 125 may be coated with PTFE or PFA or finished with coating. Alternatively, a PTFE or PFA sheet having a decreased friction coefficient may be sandwiched between the elongate increased thermal conductivity conductor 125 and the fixing belt 21 or a slide sheet manufactured by weaving PTFE or PFA fiber into web may be interposed between the elongate increased thermal conductivity conductor 125 and the fixing belt 21. Fluorine or silicone grease or oil may be applied to the elongate increased thermal conductivity conductor 125 as a lubricant that reduces the friction coefficient μ.

As shown in FIG. 9, the elongate increased thermal conductivity conductor 125 is mounted on the nip face 124*n* of the nip formation pad 124. Alternatively, the elongate increased thermal conductivity conductor 125 may be mounted on the nip face 24*n* of the nip formation pad 24 shown in FIG. 5. In this case also, the elongate increased thermal conductivity conductor 125 mounted on the nip formation pad 24 attains the advantages of the elongate increased thermal conductivity conductor 125 mounted on the nip formation pad 124 described above.

Figure 10:
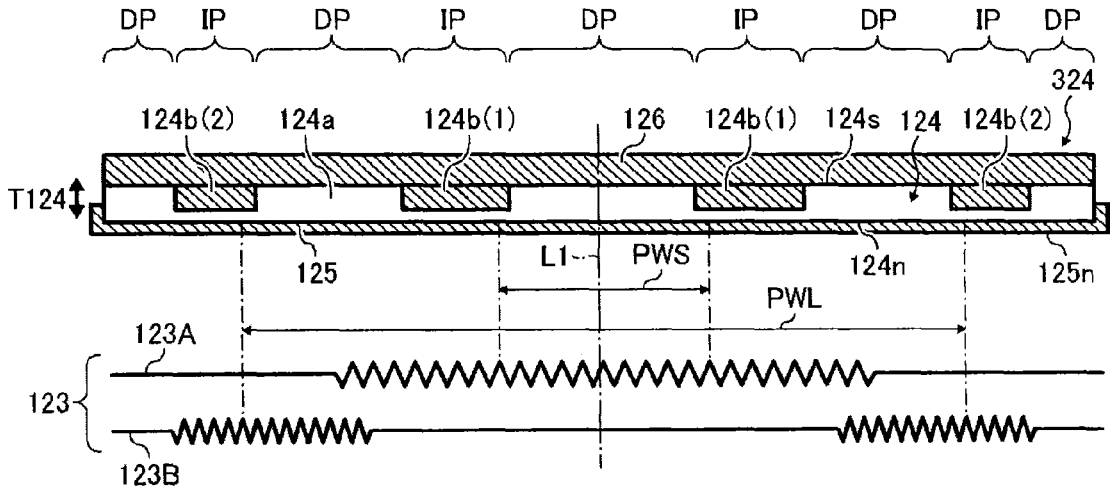
FIG. 10 is a schematic horizontal sectional view of an alternate nip formation assembly and the halogen heater pair installable in the fixing device shown in FIG. 7.

With reference to FIG. 10, a description is provided of a construction of a nip formation assembly 324 mounting an increased thermal conductivity conductor on each of the nip face 124*n* of the nip formation pad 124 and an opposite face 124*s* opposite the nip face 124*n* as a fourth example.

FIG. 10 is a schematic horizontal sectional view of the nip formation assembly 324 and the halogen heater pair 123 installable in the fixing device 20S depicted in FIG. 7. As shown in FIG. 10, the nip formation assembly 324 includes the nip formation pad 124, the elongate increased thermal conductivity conductor 125, and an elongate increased thermal conductivity conductor 126. The nip face 124*n*, that is, the lower face in FIG. 10, of the nip formation pad 124 mounts the elongate increased thermal conductivity conductor 125 extending throughout the entire width of the nip formation pad 124 in the longitudinal direction thereof parallel to the axial direction of the fixing belt 21. The opposite face 124*s*, that is, an upper face in FIG. 10, of the nip formation pad 124 mounts the elongate increased thermal conductivity conductor 126 extending throughout the entire width of the nip formation pad 124 in the longitudinal direction thereof parallel to the axial direction of the fixing belt 21. Except for the elongate increased thermal conductivity conductor 126, the construction of the nip formation assembly 324 is equivalent to that of the nip formation assembly 224 depicted in FIG. 9. Hence, redundant description is omitted and difference from the nip formation assembly 224 is explained below.

The elongate increased thermal conductivity conductor 126 mounted on the opposite face 124*s* of the nip formation pad 124 absorbs heat from the first increased thermal conductivity conductors 124*b*(1) and the second increased thermal conductivity conductors 124*b*(2) that absorb heat from the overheated fixing belt 21 through the elongate increased thermal conductivity conductor 125 and the base 124*a*. The elongate increased thermal conductivity conductor 126 contacts the first increased thermal conductivity conductors 124*b*(1) and the second increased thermal conductivity conductors 124*b*(2).

The first increased thermal conductivity conductors 124*b*(1) and the second increased thermal conductivity conductors 124*b*(2) do not extend throughout the entire width of the nip formation pad 124 in the longitudinal direction thereof but extend in a part of the nip formation pad 124 in the longitudinal direction thereof. Accordingly, the first increased thermal conductivity conductors 124*b*(1) and the second increased thermal conductivity conductors 124*b*(2) have insufficient thermal capacity and therefore absorb heat from the overheated fixing belt 21 insufficiently. To address this circumstance, the elongate increased thermal conductivity conductor 126 having an increased thermal capacity and an increased thermal conductivity that facilitate quick heat absorption and suppress temperature saturation is mounted on the opposite face 124*s* of the nip formation pad 124 to absorb heat from the fixing belt 21 sufficiently. The elongate increased thermal conductivity conductor 126 is made of a material having an increased thermal conductivity, for example, copper, aluminum, or the like. The elongate increased thermal conductivity conductor 126 is made of a material identical to or different from a material of the first increased thermal conductivity conductor 124*b*(1), the second increased thermal conductivity conductor 124*b*(2), or the elongate increased thermal conductivity conductor 125.

Figure 11:
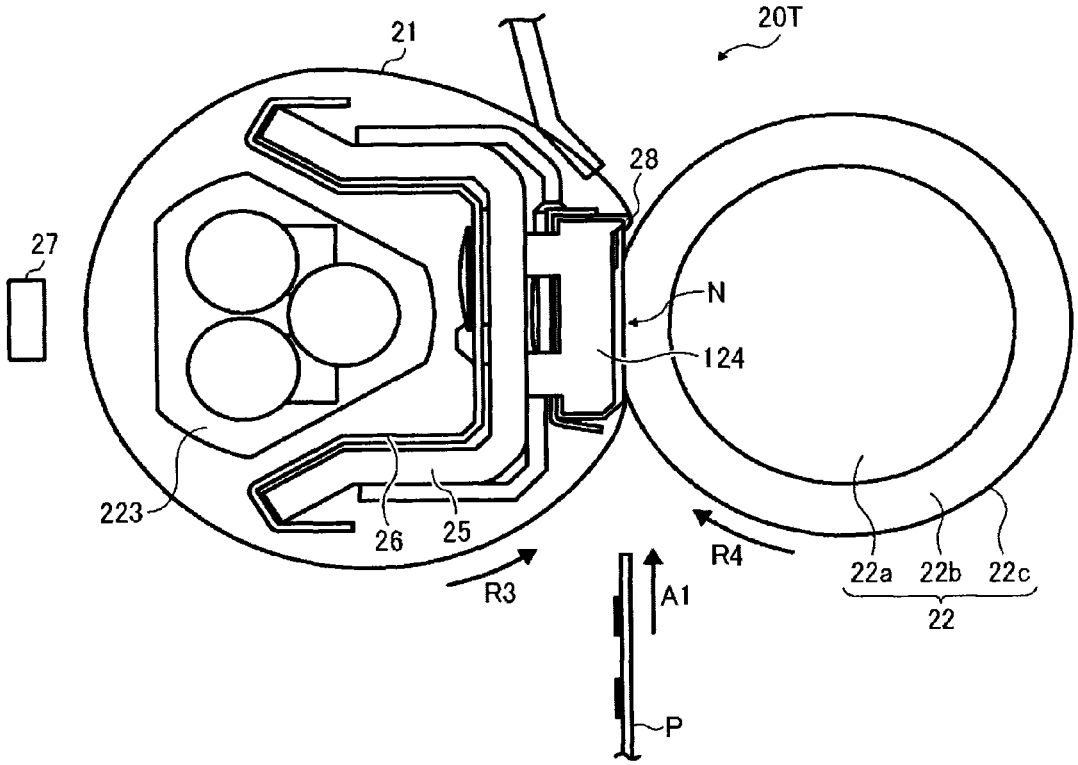
FIG. 11 is a vertical sectional view of a fixing device according to a third exemplary embodiment.

With reference to FIG. 11, a description is provided of a construction of a fixing device 20T according to a third exemplary embodiment.

FIG. 11 is a vertical sectional view of the fixing device 20T. Unlike the fixing device 20 shown in FIG. 2 that includes the single halogen heater 23, the fixing device 20T shown in FIG. 11 includes a halogen heater trio 223 constructed of three halogen heaters and serving as a heater for heating the fixing belt 21. Other components of the fixing device 20T are substantially equivalent to those of the fixing device 20. Hence, identical reference numerals are assigned to the components of the fixing device 20T equivalent to those of the fixing device 20. With the increased number of the halogen heaters, the fixing device 20T performs fixing on sheets P of various sizes while maintaining productivity. Like the fixing device 20 shown in FIG. 2, the fixing device 20T shown in FIG. 11 includes the bulge 28 projecting from the downstream end of the nip formation pad 124 in proximity to the exit of the fixing nip N toward the pressure roller 22. The bulge 28 does not press against the pressure roller 22 via the fixing belt 21 and therefore is not produced by contact with the pressure roller 22. The bulge 28 facilitates separation of a sheet P from the fixing belt 21.

The halogen heater trio 223 is constructed of three heaters having different heat generation spans in a longitudinal direction thereof parallel to the axial direction of the fixing belt 21, that is, a center heater having a center heat generation span disposed at a center of the halogen heater trio 223 in the longitudinal direction thereof that corresponds to the width of a small sheet P, a first lateral end heater having a first lateral end heat generation span disposed at one lateral end of the halogen heater trio 223 in the longitudinal direction thereof that corresponds to the width of a large sheet P, and a second lateral end heater having a second lateral end heat generation span disposed at another lateral end of the halogen heater trio 223 in the longitudinal direction thereof that corresponds to the width of the large sheet P. The fixing device 20T employs the nip formation pad 124 depicted in FIG. 8, the nip formation assembly 224 depicted in FIG. 9, or the nip formation assembly 324 depicted in FIG. 10. FIG. 11 illustrates the nip formation pad 124 depicted in FIG. 8. According to the exemplary embodiments described above, the increased thermal conduction portion IP and the decreased thermal conduction portion DP of the nip formation pad 124 are made of the material of the nip formation pad 24 depicted in FIG. 5.

With reference to FIGS. 12 to 17, a description is provided of installation examples of the nip formation pads 24 and 124 and the nip formation assemblies 224 and 324 described above.

FIGS. 12 to 17 illustrate a nip formation assembly 240 including the two increased thermal conduction portions IP symmetrical with each other via the center line L1 about which a sheet P conveyed over the fixing belt 21 is centered as shown in FIG. 4, an elongate increased thermal conductivity conductor mounted on a nip face of a nip formation pad, and an elongate increased thermal conductivity conductor mounted on an opposite face opposite the nip face of the nip formation pad like the nip formation assembly 324 depicted in FIG. 10.

Figure 12:
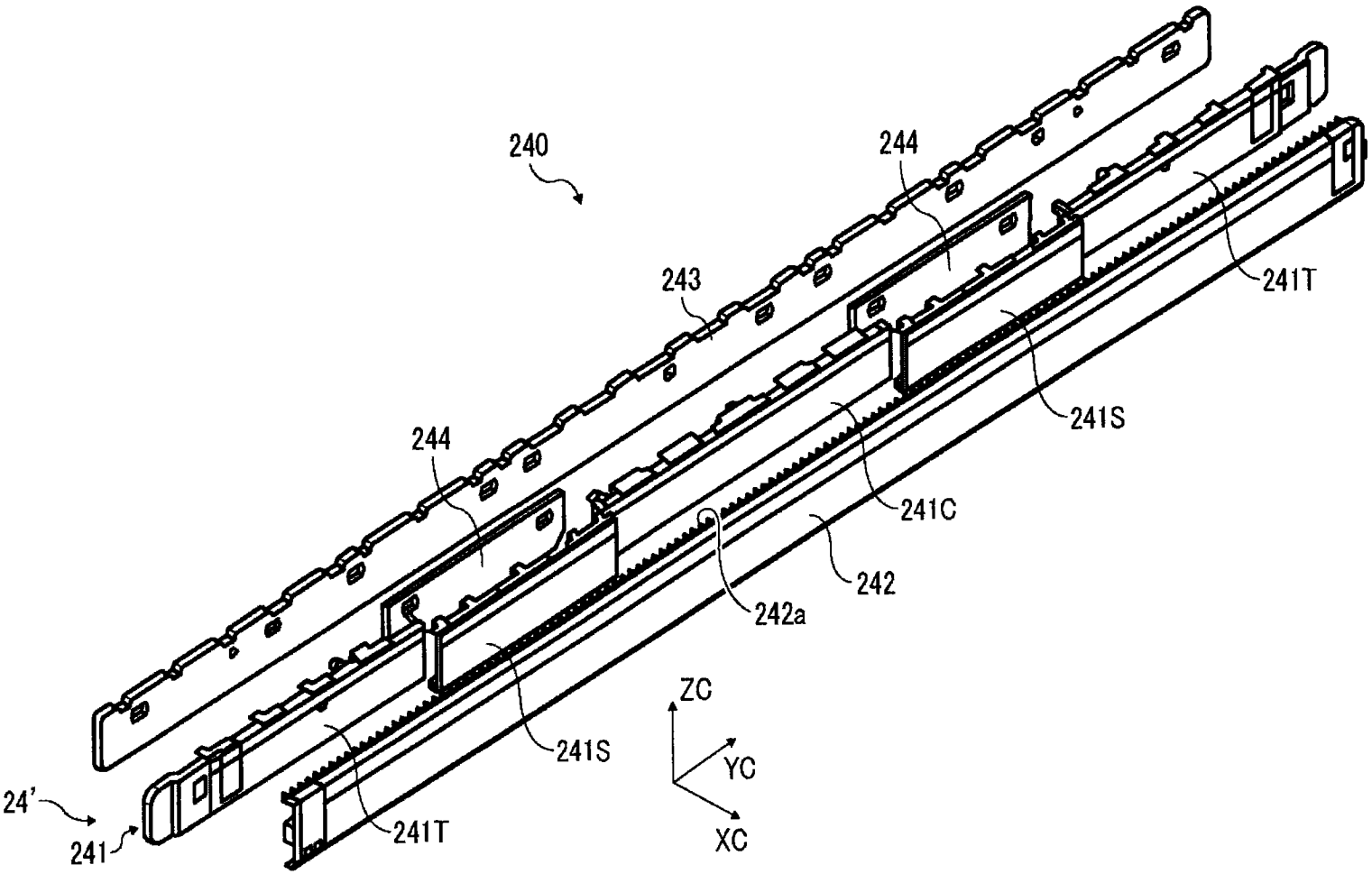
FIG. 12 is an exploded perspective view of a nip formation assembly seen from a fixing nip formed between the fixing belt and a pressure roller incorporated in the fixing device shown in FIG. 2.
Figure 13:
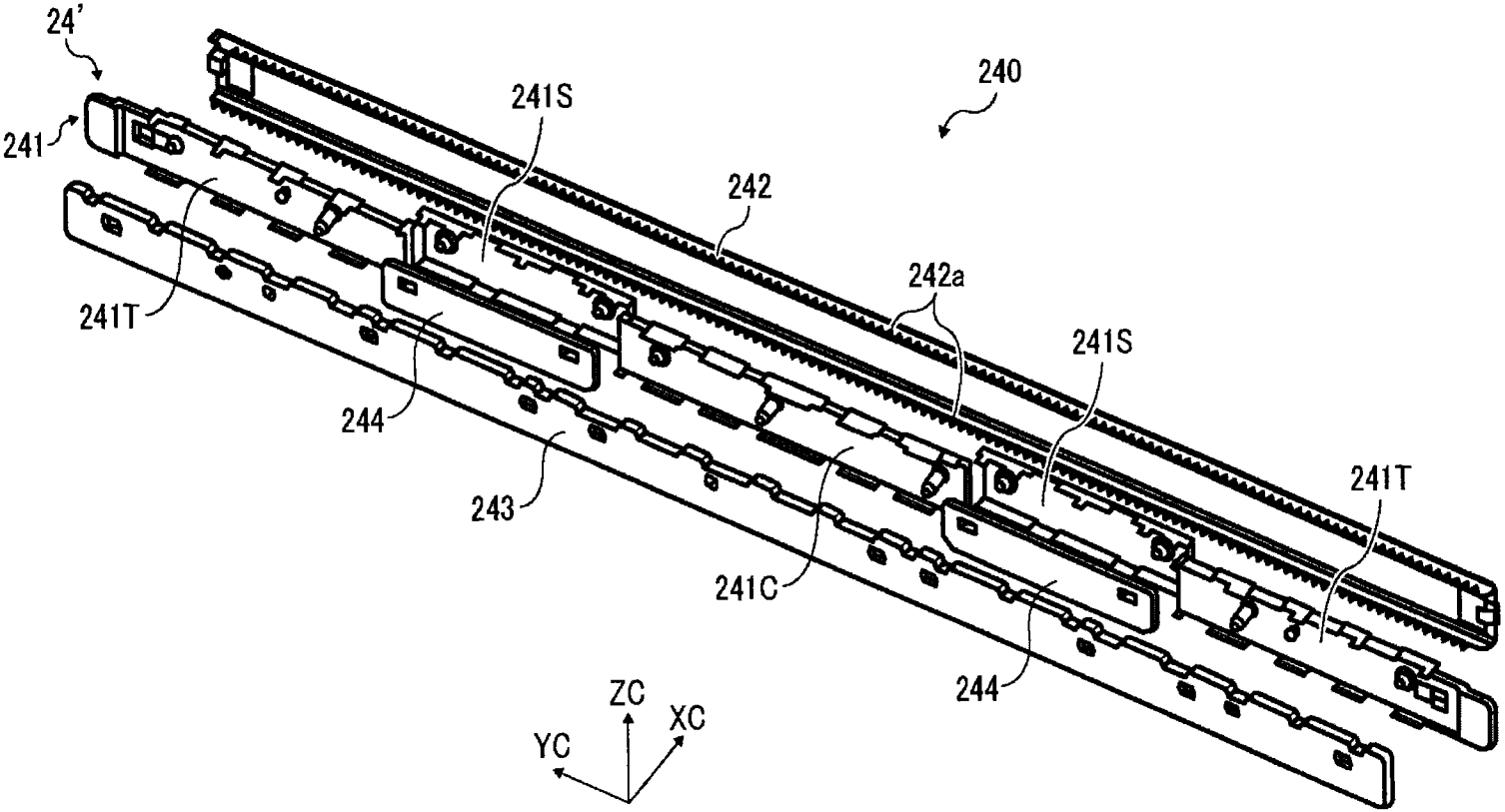
FIG. 13 is an exploded perspective view of the nip formation assembly shown in FIG. 12 seen from a stay incorporated in the fixing device shown in FIG. 2.

FIG. 12 is an exploded perspective view of the nip formation assembly 240 seen from the fixing nip N. FIG. 13 is an exploded perspective view of the nip formation assembly 240 seen from the stay 25 depicted in FIG. 2 that is disposed opposite the fixing nip N via the nip formation assembly 240. A coordinate axis XC defines a thickness direction of the nip formation assembly 240 corresponding to the thickness direction T24 depicted in FIG. 4. A coordinate axis YC defines the width direction of the sheet P parallel to the axial direction of the fixing belt 21 and perpendicular to the sheet conveyance direction A1 depicted in FIG. 2. A coordinate axis ZC defines the sheet conveyance direction A1.

As shown in FIGS. 12 and 13, the nip formation assembly 240 includes a nip formation pad 24', a fixing nip side, increased thermal conductivity conductor 242, and a stay side, increased thermal conductivity conductor 243. The nip formation pad 24' includes a base 241 and interior increased thermal conductivity conductors 244.

A detailed description is now given of a construction of the base 241.

The base 241 serving as a first thermal conductor having a decreased thermal conductivity includes a center portion 241C, two lateral end portions 241T, and two bridge portions 241S. For example, the base 241 is made of general heat resistant resin such as polyether sulfone (PES), PPS, LCP, polyether nitrile (PEN), PAI, and PEEK. Alternatively, the base 241 may not be divided into a plurality of portions (e.g., the center portion 241C, the lateral end portions 241T, and the bridge portions 241S) and may be manufactured into a single portion.

A detailed description is now given of a configuration of the fixing nip side, increased thermal conductivity conductor 242.

The fixing nip side, increased thermal conductivity conductor 242 covers a nip face of the nip formation pad 24' and is made of metal having an increased thermal conductivity such as copper and aluminum. According to this exemplary embodiment, the fixing nip side, increased thermal conductivity conductor 242 is made of copper.

Teeth 242*a* mounted on both ends of the fixing nip side, increased thermal conductivity conductor 242 in the sheet conveyance direction A1 indicated by the coordinate axis ZC, respectively, catch or engage a low-friction sheet covering the fixing nip side, increased thermal conductivity conductor 242 to prevent the low-friction sheet from being displaced in accordance with rotation of the fixing belt 21. As shown in FIG. 12, the teeth 242*a* are produced on both ends of the fixing nip side, increased thermal conductivity conductor 242 in the sheet conveyance direction A1. Alternatively, the teeth 242*a* may be produced at an upstream end of the fixing nip side, increased thermal conductivity conductor 242 in the sheet conveyance direction A1 corresponding to the rotation direction R3 of the fixing belt 21. Conversely, a downstream end of the fixing nip side, increased thermal conductivity conductor 242 in the sheet conveyance direction A1 may be planar.

A detailed description is now given of a configuration of the stay side, increased thermal conductivity conductor 243.

The stay side, increased thermal conductivity conductor 243 is mounted on an opposite face opposite the nip face of the nip formation pad 24' and in contact with the stay 25 depicted in FIG. 2. Like the fixing nip side, increased thermal conductivity conductor 242, the stay side, increased thermal conductivity conductor 243 is made of metal having an increased thermal conductivity such as copper and aluminum.

A detailed description is now given of a configuration of the interior increased thermal conductivity conductor 244 serving as a second thermal conductor or an increased thermal conductivity conductor.

The interior increased thermal conductivity conductor 244 is interposed between the stay side, increased thermal conductivity conductor 243 and the base 241, for example, the bridge portion 241S of the base 241 according to this exemplary embodiment. Like the fixing nip side, increased thermal conductivity conductor 242 and the stay side, increased thermal conductivity conductor 243, the interior increased thermal conductivity conductor 244 is made of metal having an increased thermal conductivity such as copper and aluminum.

A part of the base 241 that accommodates the interior increased thermal conductivity conductor 244 has a decreased thickness. A combined thickness combining a thickness of the bridge portion 241S of the base 241 and a thickness of the interior increased thermal conductivity conductor 244 layered on the bridge portion 241S is equivalent to a thickness of the center portion 241C of the base 241.

A detailed description is now given of the thickness of the components of the nip formation assembly 240 when a nip length of the fixing nip N in the sheet conveyance direction A1 is about 10 mm.

The fixing nip side, increased thermal conductivity conductor 242 has a thickness in a range of from about 0.2 mm to about 1.0 mm. The stay side, increased thermal conductivity conductor 243 has a thickness in a range of from about 1.8 mm to about 6.0 mm. The interior increased thermal conductivity conductor 244 serving as a heat absorption plate has a thickness in a range of from about 1.0 mm to about 2.0 mm. The bridge portion 241S of the base 241 serving as a heat absorption restraint plate has a thickness in a range of from about 0.5 mm to about 1.5 mm. The center portion 241C and the lateral end portion 241T of the base 241 having a decreased thermal conductivity have a thickness in a range of from about 1.5 mm to about 3.5 mm. However, the thickness of those components is not limited to the above.

A detailed description is now given of a construction of the center portion 241C of the base 241.

Figure 14A:
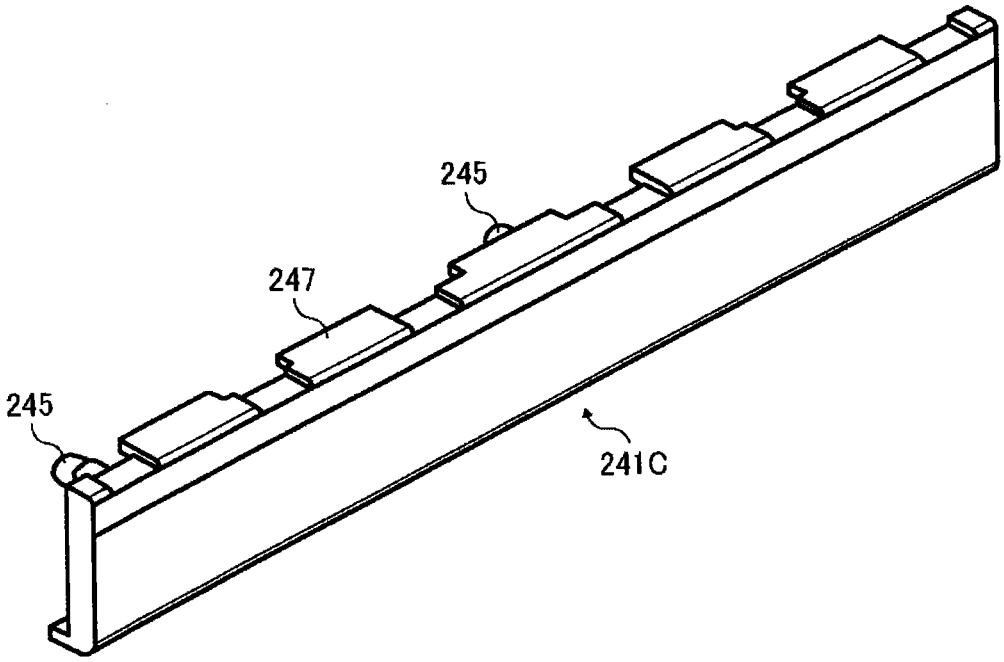
FIG. 14A is a perspective view of a center portion of a base incorporated in the nip formation assembly shown in FIG. 12 seen from the fixing nip.
Figure 14B:
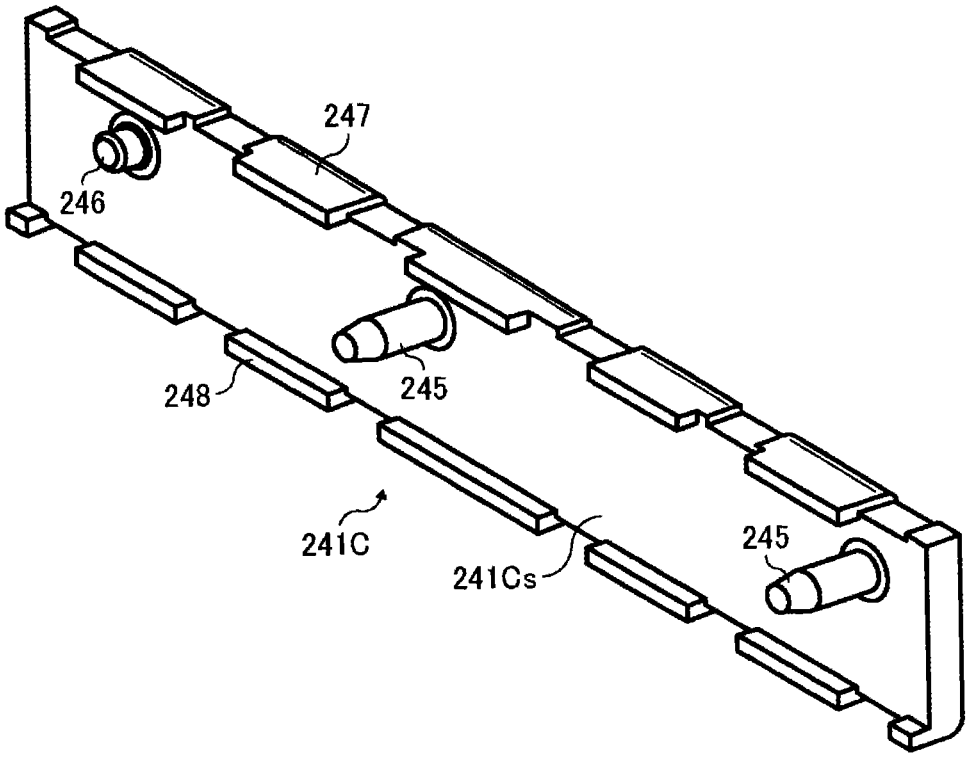
FIG. 14B is a perspective view of the center portion of the base shown in FIG. 14A seen from the stay disposed opposite the fixing nip.

FIG. 14A is a perspective view of the center portion 241C of the base 241 seen from the fixing nip N. FIG. 14B is a perspective view of the center portion 241C of the base 241 seen from the stay 25 disposed opposite the fixing nip N via the nip formation assembly 240. As shown in FIG. 14B, two ribs 245 and a single rib 246 project from a stay side face 241Cs of the center portion 241C. The ribs 245 penetrate through through-holes penetrating through the stay side, increased thermal conductivity conductor 243 depicted in FIG. 13 and reach the stay 25 depicted in FIG. 2. The rib 246 engages a positioning through-hole or a recess produced in the stay side, increased thermal conductivity conductor 243.

A plurality of marginal projections 247 and 248 projects from both ends of the center portion 241C in a short direction thereof, respectively. The stay side, increased thermal conductivity conductor 243 is fitted between the marginal projections 247 and 248 and secured to the center portion 241C.

A detailed description is now given of a construction of the lateral end portion 241T.

Figure 15A:
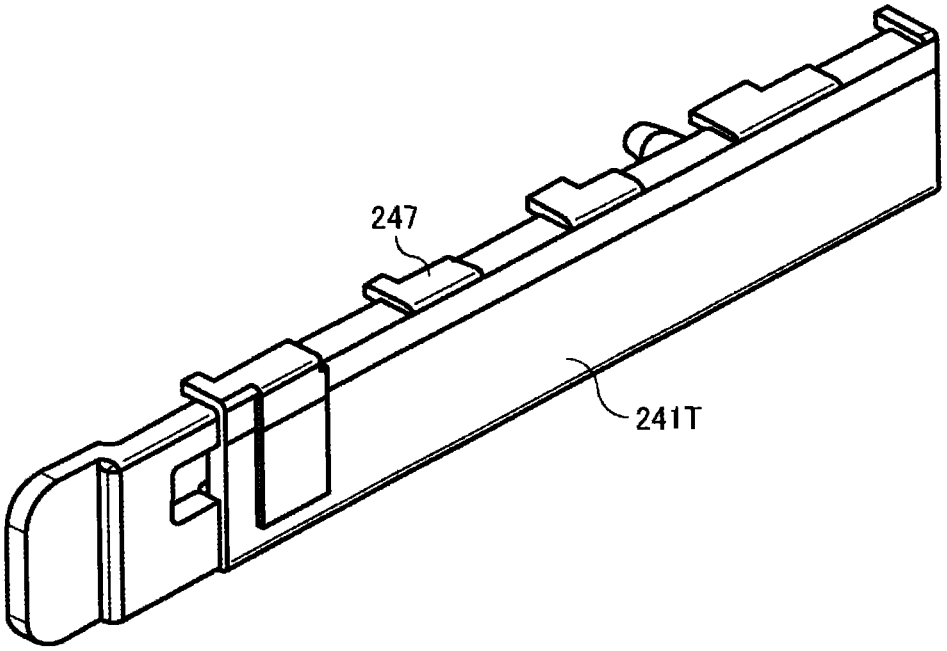
FIG. 15A is a perspective view of a lateral end portion of the base incorporated in the nip formation assembly shown in FIG. 12 seen from the fixing nip.
Figure 15B:
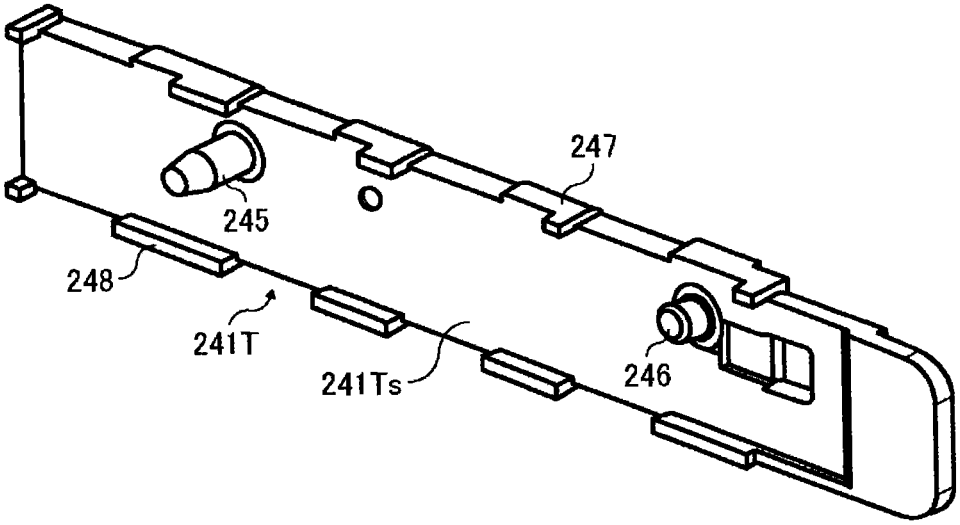
FIG. 15B is a perspective view of the lateral end portion of the base shown in FIG. 15A seen from the stay disposed opposite the fixing nip.

FIG. 15A is a perspective view of the lateral end portion 241T of the base 241 seen from the fixing nip N. FIG. 15B is a perspective view of the lateral end portion 241T of the base 241 seen from the stay 25 disposed opposite the fixing nip N via the nip formation assembly 240. As shown in FIG. 15B, a single rib 245 and a single rib 246 project from a stay side face 241Ts of the lateral end portion 241T. The rib 245 penetrates through the stay side, increased thermal conductivity conductor 243 depicted in FIG. 13 and reaches the stay 25 depicted in FIG. 2. The rib 246 engages the stay side, increased thermal conductivity conductor 243.

A plurality of marginal projections 247 and 248 projects from both ends of the lateral end portion 241T in a short direction thereof, respectively. The stay side, increased thermal conductivity conductor 243 is fitted between the marginal projections 247 and 248 and secured to the lateral end portion 241T.

As shown in FIGS. 12 and 13, the two lateral end portions 241T are disposed at both lateral ends of the base 241 in a longitudinal direction thereof, respectively. However, since the lateral end portions 241T symmetrical with each other via the center portion 241C have symmetrical shapes in the longitudinal direction of the base 241, FIGS. 15A and 15B illustrate one of the two lateral end portions 241T.

Figure 16A:
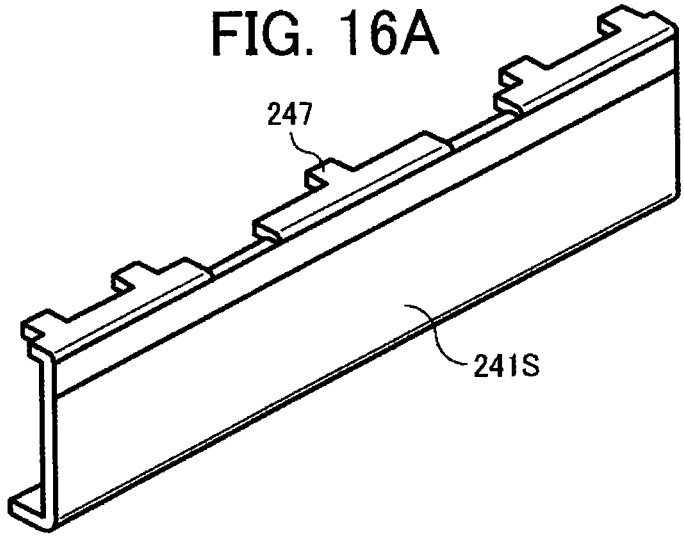
FIG. 16A is a perspective view of a bridge portion of the base incorporated in the nip formation assembly shown in FIG. 12 seen from the fixing nip.
Figure 16B:
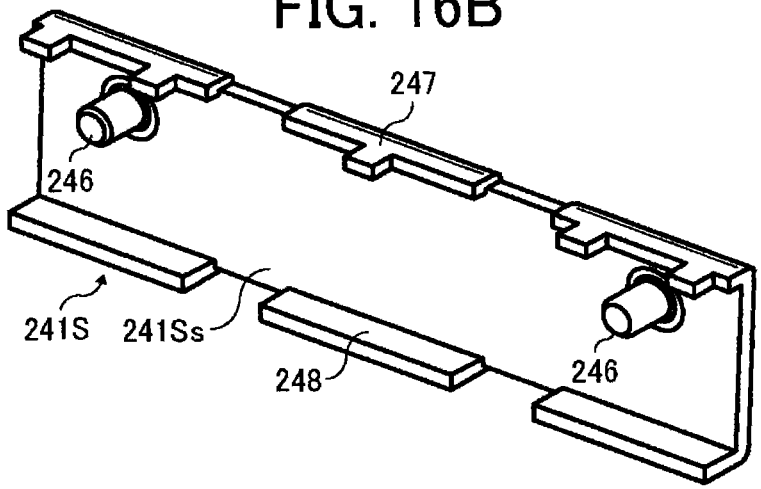
FIG. 16B is a perspective view of the bridge portion of the base shown in FIG. 16A seen from the stay disposed opposite the fixing nip.

With reference to FIGS. 16A and 16B, a detailed description is now given of a construction of the bridge portion 241S.

FIG. 16A is a perspective view of the bridge portion 241S of the base 241 seen from the fixing nip N. FIG. 16B is a perspective view of the bridge portion 241S of the base 241 seen from the stay 25 disposed opposite the fixing nip N via the nip formation assembly 240. As shown in FIG. 16B, two ribs 246 project from a stay side face 241Ss of the bridge portion 241S toward the interior increased thermal conductivity conductor 244. The ribs 246 penetrate through through-holes penetrating through the interior increased thermal conductivity conductor 244 depicted in FIG. 13, respectively, and engage the stay side, increased thermal conductivity conductor 243.

A plurality of marginal projections 247 and 248 projects from both ends of the bridge portion 241S in a short direction thereof, respectively. The interior increased thermal conductivity conductor 244 and the stay side, increased thermal conductivity conductor 243 are fitted between the marginal projections 247 and 248 and secured to the bridge portion 241S. As shown in FIGS. 12 and 13, the base 241 of the nip formation assembly 240 includes the two bridge portions 241S. However, since the two bridge portions 241S have identical or symmetrical shapes in the longitudinal direction of the base 241, FIGS. 16A and 16B illustrate one of the two bridge portions 241S.

Figure 17:
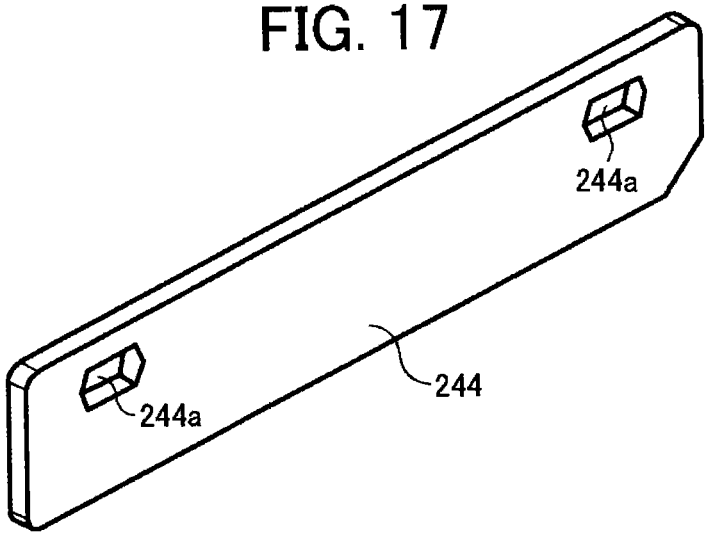
FIG. 17 is a perspective view of an interior increased thermal conductivity conductor incorporated in the nip formation assembly shown in FIG. 12.

With reference to FIG. 17, a detailed description is now given of a construction of the interior increased thermal conductivity conductor 244.

FIG. 17 is a perspective view of the interior increased thermal conductivity conductor 244. Two through-holes 244*a* penetrate through the interior increased thermal conductivity conductor 244 to engage the ribs 246 of the bridge portion 241S depicted in FIG. 16B. The interior increased thermal conductivity conductor 244 serving as a second thermal conductor having an increased thermal conductivity is layered on the bridge portion 241S of the base 241 serving as a first thermal conductor having a decreased thermal conductivity, producing the increased thermal conduction portion IP depicted in FIG. 4. As shown in FIGS. 12 and 13, the nip formation assembly 240 includes the two interior increased thermal conductivity conductors 244. However, since the two interior increased thermal conductivity conductors 244 have symmetrical shapes in the longitudinal direction of the base 241, FIG. 17 illustrates one of the two interior increased thermal conductivity conductors 244.

The fixing devices 20, 20S, and 20T according to the exemplary embodiments described above employ a centering method in which the sheet P conveyed over the fixing belt 21 is centered in the axial direction of the fixing belt 21 at the sheet alignment reference (e.g., the center line L1 depicted in FIGS. 5, 8, 9, and 10). Alternatively, the fixing devices 20, 20S, and 20T may employ a one side alignment method in which the sheet P conveyed over the fixing belt 21 is aligned along one lateral edge of the fixing belt 21 in the axial direction thereof. For example, in the one side alignment method, the sheet P is conveyed in a sheet conveyance path such that the sheet P is aligned along one lateral edge of the sheet conveyance path. Accordingly, the increased thermal conduction portion IP is placed in the nip formation pad (e.g., the nip formation pads 24, 124, and 24') at a position where the increased thermal conduction portion IP is disposed opposite a lateral end of the sheet P in the width direction thereof. Further, the longitudinal size of the increased thermal conduction portion IP in the longitudinal direction of the nip formation pad and the like are determined according to the lateral end of the sheet P in the width direction thereof.

With a fixing device incorporating a plurality of heaters that heats the fixing belt 21 and employing the one side alignment method, the position, the longitudinal size, and the like of the plurality of increased thermal conduction portions IP placed in the nip formation pad are determined according to heat generation spans of the plurality of heaters. The nip formation assembly 224 depicted in FIG. 9 incorporating the elongate increased thermal conductivity conductor 125 and the nip formation assembly 324 depicted in FIG. 10 incorporating the elongate increased thermal conductivity conductors 125 and 126 are also installable in the fixing device employing the one side alignment method.

As described above, the fixing devices 20, 20S, and 20T suppress overheating of each lateral end of the fixing belt 21 in the axial direction thereof, that is, the non-conveyance span NS where a small sheet P is not conveyed and prevent hot offset of toner of a toner image on the sheet P in the lateral end in proximity to each lateral edge PE of the sheet P, improving quality in fixing the toner image on the sheet P.

As shown in FIG. 4, the outboard edge 24*b*2 of the increased thermal conductivity conductor 24*b* constituting the increased thermal conduction portion IP is inboard from the lateral edge 23E of the halogen heater 23, that is, a lateral edge of the heating width HW, by the predetermined distance A in the longitudinal direction of the halogen heater 23 parallel to the axial direction of the fixing belt 21 and perpendicular to the sheet conveyance direction A1. Accordingly, the nip formation pad 24 does not absorb heat from a portion of the fixing belt 21 disposed opposite a portion of the halogen heater 23 in proximity to the lateral edge 23E thereof where the fixing belt 21 is susceptible to shortage of heat. Consequently, even when a large sheet P is conveyed over the fixing belt 21, the fixing belt 21 is immune from local shortage of heat.

The increased thermal conduction portion IP is constructed of a first member or a first thermal conductor (e.g., the bases 24*a*, 124*a*, and 241) having a decreased thermal conductivity and constituting the nip face 24*n* and a second member or a second thermal conductor (e.g., the increased thermal conductivity conductors 24*b* and 124*b* and the interior increased thermal conductivity conductor 244) having an increased thermal conductivity and constituting the opposite face 24*s* opposite the nip face 24*n*, producing the thermal conductivity varying in the thickness direction T24 of the nip formation pad 24. Since the first member or the first thermal conductor having the decreased thermal conductivity constitutes the nip face 24*n*, the first member or the first thermal conductor saves energy. For example, even when the image forming apparatus 1 is powered on and warmed up from a low ambient temperature in the morning, the first member or the first thermal conductor interposed between the fixing belt 21 and the second member or the second thermal conductor suppresses heat conduction from the fixing belt 21 by preventing the second member or the second thermal conductor having the increased thermal conductivity from absorbing heat from the fixing belt 21. The increased thermal conduction portion IP is disposed opposite an overheating span of the fixing belt 21 where the fixing belt 21 is susceptible to overheating when a small sheet P is conveyed. That is, the increased thermal conduction portion IP having the increased thermal conductivity is disposed opposite the overheating span of the fixing belt 21 where heat absorption from the fixing belt 21 is needed to suppress overheating of the fixing belt 21. If the nip formation pad 24, 124, or 24' is configured to have an increased thermal conductivity at a position disposed opposite a non-overheating span of the fixing belt 21 where the fixing belt 21 is immune from overheating, the nip formation pad 24, 124, or 24' may absorb heat excessively, causing extra power supply to the halogen heater 23, the halogen heater pair 123, or the halogen heater trio 223 ineffectively and wasting energy.

As shown in FIG. 8, with the fixing device 20S incorporating the plurality of heaters (e.g., the halogen heater pair 123) having the plurality of heat generation spans corresponding to the plurality of sizes of sheets P, in addition to the increased thermal conduction portion IP incorporating the first increased thermal conductivity conductor 124*b*(1) that is disposed opposite the first heat generation span H1 of the first heater 123A, the nip formation pad 124 has the increased thermal conduction portion IP incorporating the second increased thermal conductivity conductor 124*b*(2) disposed opposite the second heat generation span H2 of the second heater 123B corresponding to a large sheet P. Thus, the nip formation pad 124 suppresses overheating of the fixing belt 21 effectively in the non-conveyance span NS of the fixing belt 21 where the sheet P is not conveyed under various sizes of sheets P and various heat generation spans of the plurality of heaters. Hence, the nip formation pad 124 improves productivity of the fixing device 20S and quality of fixing without hot offset of toner.

As shown in FIG. 9, the elongate increased thermal conductivity conductor 125 serving as a first elongate increased thermal conductivity conductor is mounted on the nip face 124*n* of the nip formation pad 124 and extends throughout the entire width of the nip formation pad 124 in the longitudinal direction thereof perpendicular to the sheet conveyance direction A1, facilitating heat conduction in the nip formation pad 124 in the longitudinal direction thereof parallel to the width direction of the sheet P.

As shown in FIG. 10, the elongate increased thermal conductivity conductor 126 serving as a second elongate increased thermal conductivity conductor is mounted on the opposite face 124*s* of the nip formation pad 124 opposite the nip face 124*n* and extends throughout the entire width of the nip formation pad 124 in the longitudinal direction thereof perpendicular to the sheet conveyance direction A1, facilitating conduction of heat absorbed by the increased thermal conduction portions IP to the elongate increased thermal conductivity conductor 126.

A description is provided of advantages of the fixing devices 20, 20S, and 20T depicted in FIGS. 2, 7, and 11, respectively.

The fixing devices 20, 20S, and 20T include the endless fixing belt 21 serving as an endless belt or a fixing rotator rotatable in the rotation direction R3; a heater (e.g., the halogen heater 23, the halogen heater pair 123, and the halogen heater trio 223) disposed opposite the fixing belt 21 to heat the fixing belt 21; a nip formation pad (e.g., the nip formation pads 24, 124, and 24') disposed opposite the inner circumferential surface of the fixing belt 21; and the pressure roller 22 serving as a pressure rotator pressed against the nip formation pad via the fixing belt 21 to form the fixing nip N between the fixing belt 21 and the pressure roller 22 through which a sheet P serving as a recording medium is conveyed. The nip formation pad is made of a plurality of materials having different thermal conductivities, respectively.

As shown in FIGS. 5, 8, 9, and 10, the nip formation pad includes the increased thermal conduction portion IP having an increased thermal conductivity to conduct heat in a thickness direction of the nip formation pad and the decreased thermal conduction portion DP having a decreased thermal conductivity to conduct heat in the thickness direction of the nip formation pad. The outboard edge **24*b*2 or 124*b*2 of the increased thermal conduction portion IP is disposed opposite the non-conveyance span NS of the fixing belt 21 where the sheet P is not conveyed. The inboard edge 24*b*1 or 124*b*1 of the increased thermal conduction portion IP is inboard from the lateral edge PE or B4E of the sheet P in the axial direction of the fixing belt 21 by the predetermined distance B. That is, the increased thermal conduction portion IP spans from the non-conveyance span NS of the fixing belt 21 to a proximate reference PR disposed inboard from the lateral edge PE of the sheet P toward the sheet alignment reference (e.g., the center line L1) in the axial direction of the fixing belt 21. Conversely, the decreased thermal conduction portion DP is inboard from the increased thermal conduction portion IP in the axial direction of the fixing belt 21. For example, the decreased thermal conduction portion DP spans from the inboard edge 24*b*1 of the increased thermal conduction portion IP to the sheet alignment reference in the axial direction of the fixing belt 21**.

Accordingly, even when a small sheet P is conveyed over the fixing belt 21, the nip formation pad suppresses overheating of the non-conveyance span NS of the fixing belt 21 disposed at the lateral end of the fixing belt 21 in the axial direction thereof and prevents hot offset of toner of the toner image formed on the lateral end of the small sheet P in proximity to the lateral edge PE of the sheet P, achieving high quality fixing.

The configurations of the fixing devices 20, 20S, and 20T are not limited to those of the exemplary embodiments described above. For example, the number of the heaters and the location of the heaters may be changed arbitrarily. Heaters other than the halogen heater may be employed. The material of a belt or a film used as the fixing rotator and the configuration of the pressure rotator may be modified.

Further, the configuration of the image forming apparatus 1 may be modified arbitrarily. For example, although the image forming apparatus 1 uses toners in four colors. Alternatively, the image forming apparatus 1 may be a full color image forming apparatus using toners in three colors, a multicolor image forming apparatus using toners in two colors, or a monochrome image forming apparatus using toner in a single color.

According to the exemplary embodiments described above, the fixing belt 21 serves as an endless belt or a fixing rotator. Alternatively, a fixing film, a fixing sleeve, or the like may be used as an endless belt or a fixing rotator. Further, the pressure roller 22 serves as a pressure rotator. Alternatively, a pressure belt or the like may be used as a pressure rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

at least one heater disposed opposite the fixing rotator to heat the fixing rotator;

a nip formation pad disposed opposite an inner circumferential surface of the fixing rotator; and a pressure rotator pressed against the nip formation pad via the fixing rotator to form a fixing nip between the fixing rotator and the pressure rotator, the fixing nip through which a recording medium is conveyed along a recording medium path, the nip formation pad including:

an increased thermal conduction portion having an increased thermal conductivity to conduct heat in a thickness direction of the nip formation pad perpendicular to an axial direction of the fixing rotator; and a decreased thermal conduction portion having a decreased thermal conductivity to conduct heat in the thickness direction of the nip formation pad and being inboard from the increased thermal conduction portion in the axial direction of the fixing rotator, wherein:

the increased thermal conduction portion is adjacent to the decreased thermal conduction portion such that the increased thermal conduction portion and the decreased thermal conduction portion alternate along a direction which is perpendicular to the recording medium path.

2. The fixing device according to claim 1, wherein the nip formation pad is made of a plurality of materials having different thermal conductivities, respectively.

3. The fixing device according to claim 1, wherein the decreased thermal conduction portion is inboard from an inboard edge of the increased thermal conduction portion toward a center of the recording medium in the axial direction of the fixing rotator.

4. The fixing device according to claim 1, wherein the increased thermal conduction portion further includes an outboard edge inboard from an outboard edge of the heater toward the center of the recording medium in the axial direction of the fixing rotator by a predetermined distance.

5. The fixing device according to claim 1, wherein the increased thermal conduction portion includes:

a first thermal conductor having a decreased thermal conductivity and constituting a nip face of the nip formation pad disposed opposite the fixing nip; and a second thermal conductor having an increased thermal conductivity and constituting an opposite face of the nip formation pad opposite the nip face.

6. The fixing device according to claim 5, wherein the decreased thermal conduction portion includes the first thermal conductor.

7. The fixing device according to claim 5, further comprising a first elongate increased thermal conductivity conductor mounted on the nip face of the nip formation pad and extended throughout an entire width of the nip formation pad in the axial direction of the fixing rotator.

8. The fixing device according to claim 7, wherein the first elongate increased thermal conductivity conductor is made of one of copper and aluminum.

9. The fixing device according to claim 5, further comprising a second elongate increased thermal conductivity conductor mounted on the opposite face of the nip formation pad and extended throughout an entire width of the nip formation pad in the axial direction of the fixing rotator.

10. The fixing device according to claim 9, wherein the second elongate increased thermal conductivity conductor is made of one of copper and aluminum.

11. The fixing device according to claim 5, wherein the first thermal conductor is made of heat resistant resin.

12. The fixing device according to claim 5, wherein the second thermal conductor is made of one of copper and aluminum.

13. The fixing device according to claim 5, wherein the nip face of the nip formation pad has a surface roughness not greater than a surface roughness of the inner circumferential surface of the fixing rotator.

14. The fixing device according to claim 5, wherein the first thermal conductor includes:

a center portion disposed at a center of the first thermal conductor in the axial direction of the fixing rotator;

a lateral end portion disposed at a lateral end of the first thermal conductor in the axial direction of the fixing rotator; and a bridge portion bridging the center portion and the lateral end portion in the axial direction of the fixing rotator, the bridge portion layered on the second thermal conductor, and wherein a combined thickness in a direction perpendicular to the axial direction of the fixing rotator combining a thickness of the bridge portion of the first thermal conductor and a thickness of the second thermal conductor is equivalent to a thickness of the center portion of the first thermal conductor.

15. The fixing device according to claim 14, wherein the bridge portion of the first thermal conductor includes a rib projecting toward the second thermal conductor, and wherein the second thermal conductor includes a through-hole to engage the rib of the bridge portion.

16. The fixing device according to claim 1, wherein the at least one heater includes:

a first heater having a first heat generation span in the axial direction of the fixing rotator corresponding to a small recording medium; and a second heater having a second heat generation span in the axial direction of the fixing rotator corresponding to a great recording medium greater than the small recording medium.

17. The fixing device according to claim 16, wherein the nip formation pad further includes a secondary increased thermal conduction portion disposed opposite the second heat generation span of the second heater.

18. The fixing device according to claim 1, wherein the recording medium conveyed through the fixing nip is centered on the fixing rotator in the axial direction thereof.

19. The fixing device according to claim 1, wherein the fixing rotator includes a fixing belt and the pressure rotator includes a pressure roller.

20. The fixing device according to claim 1, wherein the increased thermal conduction portion includes two separate sections which are separated along a direction parallel to the axial direction of the fixing rotator by the decreased thermal conduction portion.

21. The fixing device according to claim 20, wherein the decreased thermal conduction portion comprises three sections which are separated by the two separate sections of the increased thermal conduction portion.

22. The fixing device according to claim 1, wherein:

the increased thermal conduction portion is disposed opposite a non-conveyance span of the fixing rotator where the recording medium is not conveyed and including an inboard edge inboard from a lateral edge of the recording medium toward a center of the recording medium in the axial direction of the fixing rotator by a predetermined first distance.

23. An image forming apparatus comprising:

an image forming device to form a toner image; and a fixing device, disposed downstream from the image forming device in a recording medium conveyance direction, to fix the toner image on a recording medium, the fixing device including:

a fixing rotator rotatable in a predetermined direction of rotation;

at least one heater disposed opposite the fixing rotator to heat the fixing rotator;

a nip formation pad disposed opposite an inner circumferential surface of the fixing rotator; and a pressure rotator pressed against the nip formation pad via the fixing rotator to form a fixing nip between the fixing rotator and the pressure rotator, the fixing nip through which the recording medium is conveyed along a recording medium path, the nip formation pad including:

an increased thermal conduction portion having an increased thermal conductivity to conduct heat in a thickness direction of the nip formation pad perpendicular to an axial direction of the fixing rotator; and a decreased thermal conduction portion having a decreased thermal conductivity to conduct heat in the thickness direction of the nip formation pad and being inboard from the increased thermal conduction portion in the axial direction of the fixing rotator, wherein:

the increased thermal conduction portion is adjacent to the decreased thermal conduction portion such that the increased thermal conduction portion and the decreased thermal conduction portion alternate along a direction which is perpendicular to the recording medium path.

24. The image forming apparatus according to claim 23, wherein the increased thermal conduction portion includes two separate sections which are separated along a direction parallel to the axial direction of the fixing rotator by the decreased thermal conduction portion.

25. The image forming apparatus according to claim 24, wherein the decreased thermal conduction portion comprises three sections which are separated by the two separate sections of the increased thermal conduction portion.

26. The image forming apparatus according to claim 23, wherein:

the increased thermal conduction portion is disposed opposite a non-conveyance span of the fixing rotator where the recording medium is not conveyed and including an inboard edge inboard from a lateral edge of the recording medium toward a center of the recording medium in the axial direction of the fixing rotator by a predetermined first distance.

27. A fixing device comprising:

a fixing rotator rotatable in a predetermined direction of rotation;

at least one heater disposed opposite the fixing rotator to heat the fixing rotator;

a nip formation pad disposed opposite an inner circumferential surface of the fixing rotator; and a pressure rotator pressed against the nip formation pad via the fixing rotator to form a fixing nip between the fixing rotator and the pressure rotator, the fixing nip through which a recording medium is conveyed along a recording medium path, the nip formation pad including:

a first thermal conduction portion having a first thermal conductivity to conduct heat in a thickness direction of the nip formation pad perpendicular to an axial direction of the fixing rotator; and a second thermal conduction portion having a second thermal conductivity smaller than the first thermal conductivity to conduct heat in the thickness direction of the nip formation pad and being inboard from the first thermal conduction portion in the axial direction of the fixing rotator, wherein the first thermal conduction portion is adjacent to the second thermal conduction portion such that the first thermal conduction portion and the second thermal conduction portion alternate along a direction which is perpendicular to the recording medium path.

28. An image forming apparatus comprising the fixing device of claim 27.

* * * * *